US007679287B2

(12) United States Patent
Bae

(10) Patent No.: US 7,679,287 B2
(45) Date of Patent: Mar. 16, 2010

(54) PLASMA DISPLAY APPARATUS WITH ELECTRODE STRUCTURE

(75) Inventor: Jong Woon Bae, Gumi-si (KR)

(73) Assignee: LG Electronics Inc., Seoul (KR)

( * ) Notice: Subject to any disclaimer, the term of this patent is extended or adjusted under 35 U.S.C. 154(b) by 477 days.

(21) Appl. No.: 11/642,877

(22) Filed: Dec. 21, 2006

(65) Prior Publication Data

US 2007/0290618 A1 Dec. 20, 2007

(30) Foreign Application Priority Data

Jun. 20, 2006 (KR) ..... 10-2006-0055475

(51) Int. Cl.
*H01J 17/49* (2006.01)

(52) U.S. Cl. ..... 313/582; 313/583; 313/585

(58) Field of Classification Search ..... 313/582–587, 313/292, 609

See application file for complete search history.

(56) References Cited

U.S. PATENT DOCUMENTS

2002/0175631 A1 11/2002 Kim
2004/0032215 A1 2/2004 Nishimura et al.
2004/0041522 A1* 3/2004 Takada et al. ..... 313/586
2004/0130269 A1 7/2004 Park
2005/0088090 A1 4/2005 Wu et al.
2005/0093445 A1* 5/2005 Min et al. ..... 313/582
2005/0162083 A1* 7/2005 Lee et al. ..... 313/582
2006/0232210 A1* 10/2006 Kim ..... 313/582
2007/0120485 A1* 5/2007 Kim ..... 313/582
2007/0257613 A1* 11/2007 Jung et al. ..... 313/582
2007/0278954 A1* 12/2007 Ryu et al. ..... 313/582
2008/0030136 A1* 2/2008 Bae et al. ..... 313/584

FOREIGN PATENT DOCUMENTS

CN 1471721 1/2004
EP 1 146 538 10/2001
EP 1 868 222 12/2007

OTHER PUBLICATIONS

European Search Report dated Nov. 27, 2008.
Chinese Office Action dated May 22, 2009.

* cited by examiner

*Primary Examiner*—Karabi Guharay
*Assistant Examiner*—Kevin Quarterman
(74) *Attorney, Agent, or Firm*—KED & Associates, LLP

(57) ABSTRACT

Provided is a plasma display apparatus. The plasma display apparatus includes an upper substrate, a plurality of first electrodes and second electrodes formed over the upper substrate, a lower substrate disposed facing the upper substrate, and a plurality of third electrodes formed over the lower substrate. At least one of the plurality of first electrodes and second electrodes is formed as one layer, and the first electrodes or the second electrodes are sequentially formed in at least one portion.

13 Claims, 23 Drawing Sheets

PLASMA DISPLAY APPARATUS WITH ELECTRODE STRUCTURE

This Nonprovisional application claims priority under 35 U.S.C. § 119(a) on Patent Application No. 10-2006-0055475 filed in Korea on Jun. 20, 2006, the entire contents of which are hereby incorporated by reference.

BACKGROUND OF THE INVENTION

1. Field of the Invention

The present invention relates to a plasma display apparatus, and more particularly, to a panel provided to a plasma display apparatus.

2. Description of the Background Art

In a plasma display panel, a barrier rib formed between an upper substrate and a lower substrate forms one unitary cell. Main discharge gas such as neon (Ne), helium (He) or a mixture (He+Ne) of neon and helium and inert gas containing a small amount of xenon (Xe) are filled in each cell. When a discharge is induced using a high frequency voltage, the inert gas generates vacuum ultraviolet rays and excites phosphors provided between the barrier ribs, thereby embodying an image. The plasma display panel is attracting attention as a next generation display apparatus due to its slimness and lightweightness.

FIG. 1 is a diagram illustrating a structure of a conventional plasma display panel.

As shown in FIG. 1, the plasma display panel includes an upper panel 100 and a lower panel 110. The upper panel 100 has a scan electrode 102 and a sustain electrode 103 paired on an upper substrate 101, which is a display surface for displaying an image thereon. The lower panel 110 has a plurality of address electrodes 113 arranged to intersect with a plurality of sustain electrode pairs on a lower substrate 111, which is a rear surface. The lower panel 110 is spaced apart in parallel and is sealed to the upper panel 100.

The upper panel 100 includes the scan electrode 102 and the sustain electrode 103 having including transparent electrodes 102a and 103a formed of transparent indium-tin-oxide (ITO) and bus electrodes 102b and 103b formed of metal. The scan electrode 102 and the sustain electrode 103 are covered with an upper dielectric layer 104. A protective layer 105 is formed on the upper dielectric layer 104.

The lower panel 110 includes a barrier rib 112 for partitioning a discharge cell. A plurality of address electrodes 113 is arranged in parallel with the barrier rib 112. Red (R), green (G), and blue (B) phosphors 114 are coated on the address electrode 113. A lower dielectric layer 115 is formed between the address electrode 113 and the phosphor 114.

The transparent electrodes 102*a* and 103*a* constituting the scan electrode 102 or the sustain electrode 103 of the plasma display panel are formed of expensive ITO. The transparent electrodes 102*a* and 103*a* cause an increase of a manufacturing cost of the plasma display panel. Accordingly, a great attention is drawn to manufacturing a plasma display panel reducing a manufacture cost and guaranteeing a visual characteristic and a driving characteristic enough for user's viewing.

SUMMARY OF THE INVENTION

Accordingly, the present invention is to solve at least the problems and disadvantages of the background art.

The present invention is to provide a plasma display apparatus from which a transparent ITO electrode is eliminated, thereby reducing a manufacturing cost of a plasma display panel, and improving flickering of a display image and generation of a bright defect.

To achieve these and other advantages and in accordance with the purpose of the present invention, as embodied and broadly described, there is provided a plasma display apparatus including an upper substrate, a plurality of first electrodes and second electrodes formed over the upper substrate, a lower substrate disposed facing the upper substrate, and a plurality of third electrodes formed over the lower substrate.

At least one of the plurality of first electrodes and second electrodes may be formed as one layer, and the first electrodes or the second electrodes may be sequentially formed in at least one portion.

In another aspect of the present invention, there is provided a plasma display apparatus in which at least one of a plurality of first electrodes and second electrodes is formed as one layer, and at least one of a plurality of third electrodes is up/down separated.

In a further another aspect of the present invention, there is provided a plasma display apparatus in which at least one of the plurality of first electrodes and second electrodes is formed as one layer, and the first electrodes or the second electrodes are sequentially formed in at least one portion, and in which at least two discharge cells emitting lights of colors different from each other among a plurality of discharge cells are different in pitch from each other.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Preferred embodiments of the present invention will be described in a more detailed manner with reference to the drawings.

Figure 2:
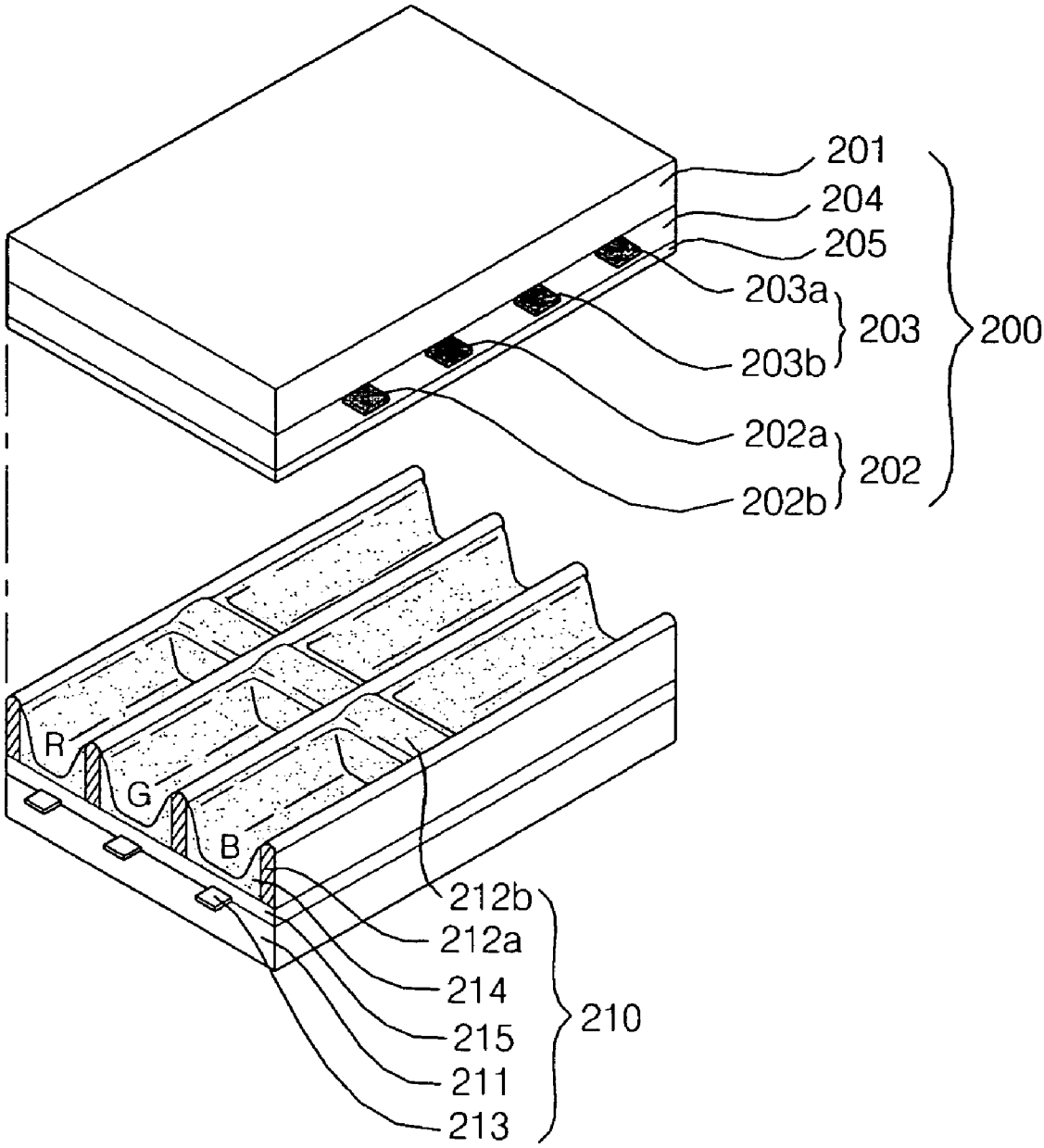
FIG. 2 is a perspective view illustrating a structure of a plasma display panel according to an exemplary embodiment of the present invention.

FIG. 2 is a perspective view illustrating a structure of a plasma display panel according to an exemplary embodiment of the present invention.

Referring to FIG. 2, the plasma display panel includes an upper panel 200 and a lower panel 210 sealed at a distance. The plasma display panel includes an address electrode 213 formed on a lower substrate 211 in the direction of intersecting with a sustain electrode pair 202 and 203; and a barrier rib 212*a* and 212*b* formed over the lower substrate 211 and partitioning a plurality of discharge cells.

The upper panel 200 includes the sustain electrode pair 202 and 203 formed on an upper substrate 201 by pair. The sustain electrode pair 202 and 203 is classified into a scan electrode 202 and a sustain electrode 203 depending on its function. The sustain electrode pair 202 and 203 is covered with an upper dielectric layer 204 for limiting a discharge current and insulating between the electrode pair. A protective layer 205 is formed on the upper dielectric layer 204. The protective layer 205 protects the upper dielectric layer 204 from sputtering of charged particles generated at the time of gas discharge, to enhance an emission efficiency of secondary electrons.

The lower panel 210 includes the barrier rib 212*a* and 212*b* for partitioning a plurality of discharge spaces, that is, discharge cells. The address electrode 213 is arranged in the direction of intersecting with the sustain electrode pair 202 and 203. A phosphor layer 214 is coated on the lower dielectric layer 215 and the barrier rib 212*a* and 212*b*. The phosphor layer 214 is excited by ultraviolet rays generated in the gas discharge, and generates visible rays.

The barrier rib 212*a* and 212*b* includes a vertical barrier rib 212*a* formed in parallel with the address electrode 213, and a horizontal barrier rib 212*b* formed in the direction of intersecting with the address electrode 213. The barrier rib 212*a* and 212*b* physically distinguishes the discharge cells, and prevents the ultraviolet rays and the visible rays generated by the discharge from leaking to an adjacent discharge cell.

Figure 1:
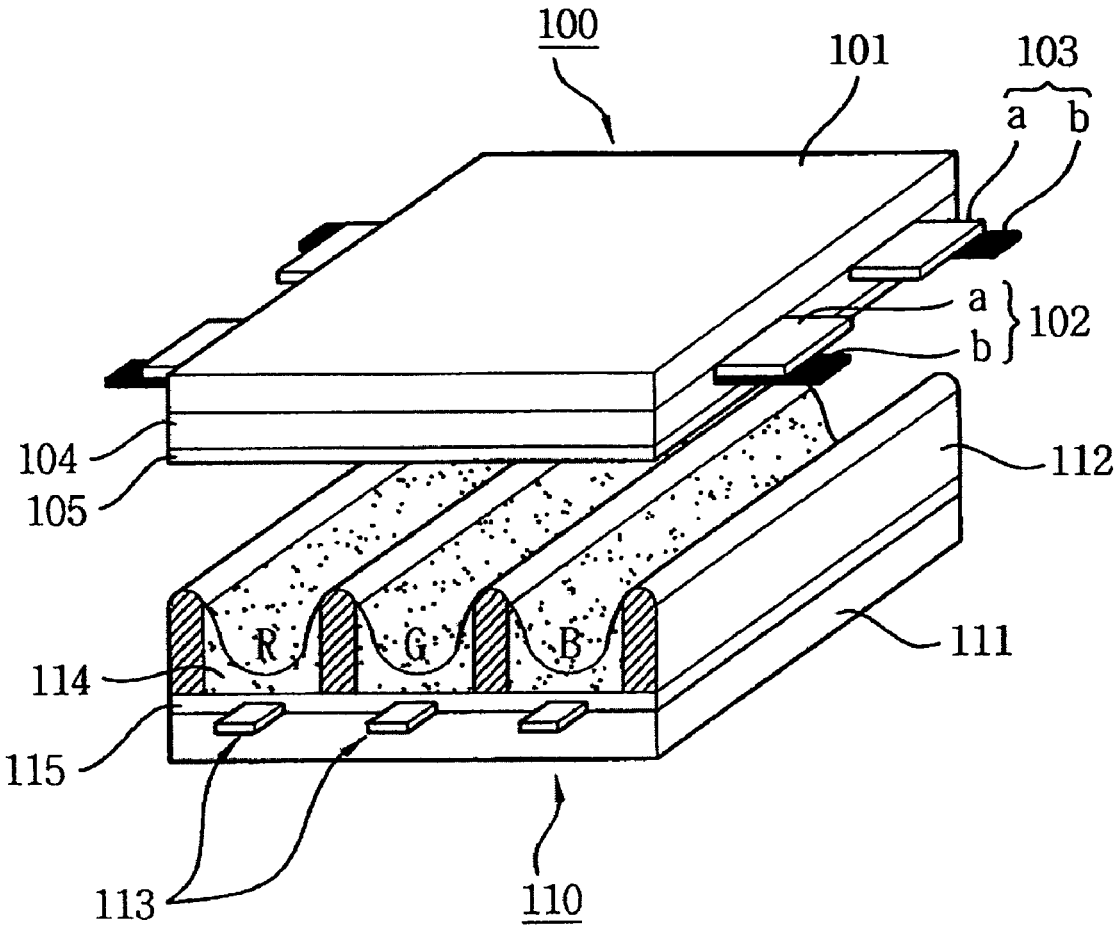
Fig.1 (related art)
FIG. 1 is a diagram illustrating a structure of a conventional panel provided to a plasma display apparatus.

In the plasma display panel according to an exemplary embodiment of the present invention, the sustain electrode pair 202 and 203 are formed of only opaque metal unlike a conventional sustain electrode pair 102 and 103 shown in FIG. 1. In other words, the sustain electrode pair 202 and 203 are formed of silver (Ag), copper (Cu), or chrome (Cr) that is a conventional bus electrode material, not indium-tin-oxide (ITO) that is a conventional transparent electrode material. In other words, in the plasma display panel according to an exemplary embodiment of the present invention, each of the sustain electrode pair 202 and 203 is constituted of the bus electrode of one layer, not the conventional ITO electrode.

For example, in an exemplary embodiment of the present invention, it is desirable that each of the sustain electrode pair 202 and 203 is formed of silver (Ag) having a photosensitive property. In an exemplary embodiment of the present invention, it is desirable that each of the sustain electrode pair 202 and 203 has a property of darker color and lower light transmission than those of the upper dielectric layer 204 formed on the upper substrate 201.

It is desirable that electrode lines 202*a*, 202*b*, and 203*a*, 203*b* have thicknesses of about 2 μm to 8 μm. The electrode lines 202*a*, 202*b*, and 203*a*, 203*b* having thicknesses of the above range can provide a resistance range and an aperture ratio making a normal operation of the plasma display panel possible. Thus, the electrode lines can be prevented from blocking lights reflected and coming out from a front surface of the plasma display apparatus, and decreasing a luminance. A capacitance of the plasma display panel does not greatly increase. It is desirable that the electrode lines 202*a*, 202*b*, and 203*a*, 203*b* have resistances of about 50Ω to 65Ω, having thicknesses of about 2 μm to 8 μm.

The respective red (R), green (G), and blue (B) phosphor layers 214 can be equal to or different from each other in width. When the phosphor layers 214 of the R, G, B discharge cells are different from each other in width, the phosphor layer 214 of the G or B discharge cell can is greater in width than the phosphor layer 214 of the R discharge cell.

As shown in FIG. 2, it is desirable that the sustain electrodes 202 and 203 are formed by a plurality of electrode lines within one discharge cell, respectively. In other words, it is desirable that the first sustain electrode 202 is formed by two electrode lines 202*a* and 202*b*, and the second sustain electrode 203 is formed by two electrode lines 203*a* and 203*b* and is disposed in symmetry with the first sustain electrode 202 on the basis of a center of the discharge cell. It is desirable that the first and second sustain electrodes 202 and 203 are a scan electrode and a sustain electrode, respectively.

This considers the aperture ratio and a discharge diffusion efficiency according to the use of the opaque sustain electrode pair 202 and 203. In other words, the first and second sustain electrodes 202 and 203 use the electrode lines of narrower widths considering the aperture ratio, and use the electrode lines in plural considering the discharge diffusion efficiency. It is desirable that the number of the electrode lines is decided, considering the aperture ratio and the discharge diffusion efficiency at the same time.

Each of the electrode lines 202*a*, 202*b*, and 203*a*, 203*b* can be formed on a predetermined black layer (not shown), not in direct contact with the upper substrate 201. In other words, the black layer can be formed between the upper substrate 201 and the respective electrode lines 202*a*, 202*b*, and 203*a*, 203*b*, thereby improving a discoloration phenomenon of the upper substrate 201, which is caused by a direct contact between the upper substrate 201 and the respective electrode lines 202*a*, 202*b*, and 203*a*, 203*b*.

The structure of the plasma display panel of FIG. 2 merely is one exemplary embodiment of the present invention and thus, the present invention is not limited to the structure of the plasma display panel of FIG. 2. For example, a black matrix (BM) can be formed on the upper substrate 201 to perform a light blocking function of absorbing external light and reducing its reflection and a function of improving a contrast of the upper substrate 201. In the black matrix, separate and integral BM structures all are possible.

In formation, the black matrix can be formed together with the black layer at the same time and can physically connect with the black layer, or can be formed at a different time and cannot physically connect with the black layer. Physically connected and formed, the black matrix and the black layer are formed using the same material. However, physically separated and formed, they can be formed using different materials.

A barrier rib structure of the plasma display panel shown in FIG. 2 is of a closed type in which the discharge cell has a closed structure by the vertical barrier rib 212*a* and the horizontal barrier rib 212*b*. However, it can also be of a stripe type having only a vertical barrier rib, or a fish bone type in which a protrusion part is formed on a vertical barrier rib at a distance.

In an exemplary embodiment of the present invention, it is possible to provide a barrier rib structure having a variety of shapes in addition to the barrier rib structure of FIG. 2. For example, it is possible to provide a differential type barrier rib structure, a channel type barrier rib structure, and a hollow type barrier rib structure. In the differential type barrier rib structure, the vertical barrier rib 212*a* and the horizontal barrier rib 212*b* have different heights. In the channel type barrier rib structure, at least one of the vertical barrier rib 212*a* and the horizontal barrier rib 212*b* has a channel that can serve as an exhaust passage. In the hollow type barrier rib structure, at least one of the vertical barrier rib 212*a* and the horizontal barrier rib 212*b* has a hollow. In the differential type barrier rib structure, it is desirable that the horizontal barrier rib 212*b* is greater in height. In the channel type barrier rib structure or the hollow type barrier rib structure, it is desirable that the horizontal barrier rib 212*b* has the channel or the hollow.

In an exemplary embodiment of the present invention, it is shown to arrange the respective R, G, B discharge cells on the same line, but it is also possible to arrange them in a different shape. For example, it is also possible to provide a delta shape arrangement in which the R, G, B discharge cells are arranged in a triangle shape. It is possible to provide the discharge cell in a rectangular shape, a pentagonal shape, and a hexagonal shape.

A width of the vertical barrier rib 212*a* and a width of the horizontal barrier rib 212*b* can be different. The width of the barrier rib can be a top width or a bottom width. It is desirable that the width of the horizontal barrier rib 212*b* is about one to five times of the width of the vertical barrier rib 212*a*.

In the plasma display panel according to an exemplary embodiment of the present invention, the R, G, B discharge cells can have substantially the same pitch. However, they can also have different pitches to adapt a color temperature adapted in the R, G, and B discharge cells. The R, G, B discharge cells can all have different pitches, but only the discharge cell expressing one color among the R, G, B discharge cells can have a different pitch. For example, it is possible that the R discharge cell have the smallest pitch, and the G and B discharge cells have greater pitches than the R discharge cell.

The address electrode formed on the lower substrate 211 can be substantially constant in width or thickness. However, a width or thickness of the address electrode within the discharge cell can be different from that of the outside of the discharge cell. For example, its width or thickness within the discharge cell can be greater than that of the outside of the discharge cell.

It is desirable that the barrier rib 212*a* and 212*b* does not use lead (Pb), or contains, though any, less lead (Pb) of 0.1 weight % or less of a total weight of the plasma display panel, or 1000 parts per million (PPM) or less.

When a total percentage of a lead component is 1000 PPM or less, a lead percentage versus the weight of the plasma display panel can be 1000 PPM or less.

Alternately, it is also possible to provide a percentage of the lead component of a specific constituent element of the plasma display panel, by 1000 PPM or less. For example, a lead percentage of the barrier rib, a lead percentage of the dielectric layer, or a lead percentage of the electrode versus each weight of the constituent elements (the barrier rib, the dielectric layer, and the electrode) can be 1000 PPM or less.

It is also possible to provide lead percentages of all constituent elements of the barrier rib, the dielectric layer, and the phosphor layer of the plasma display panel versus the weight of the plasma display panel, by 1000 PPM or less. The reason why a total percentage of a lead component is set to 1000 PPM or less as above is that the lead component can have a bad influence on a human body.

Figure 3:
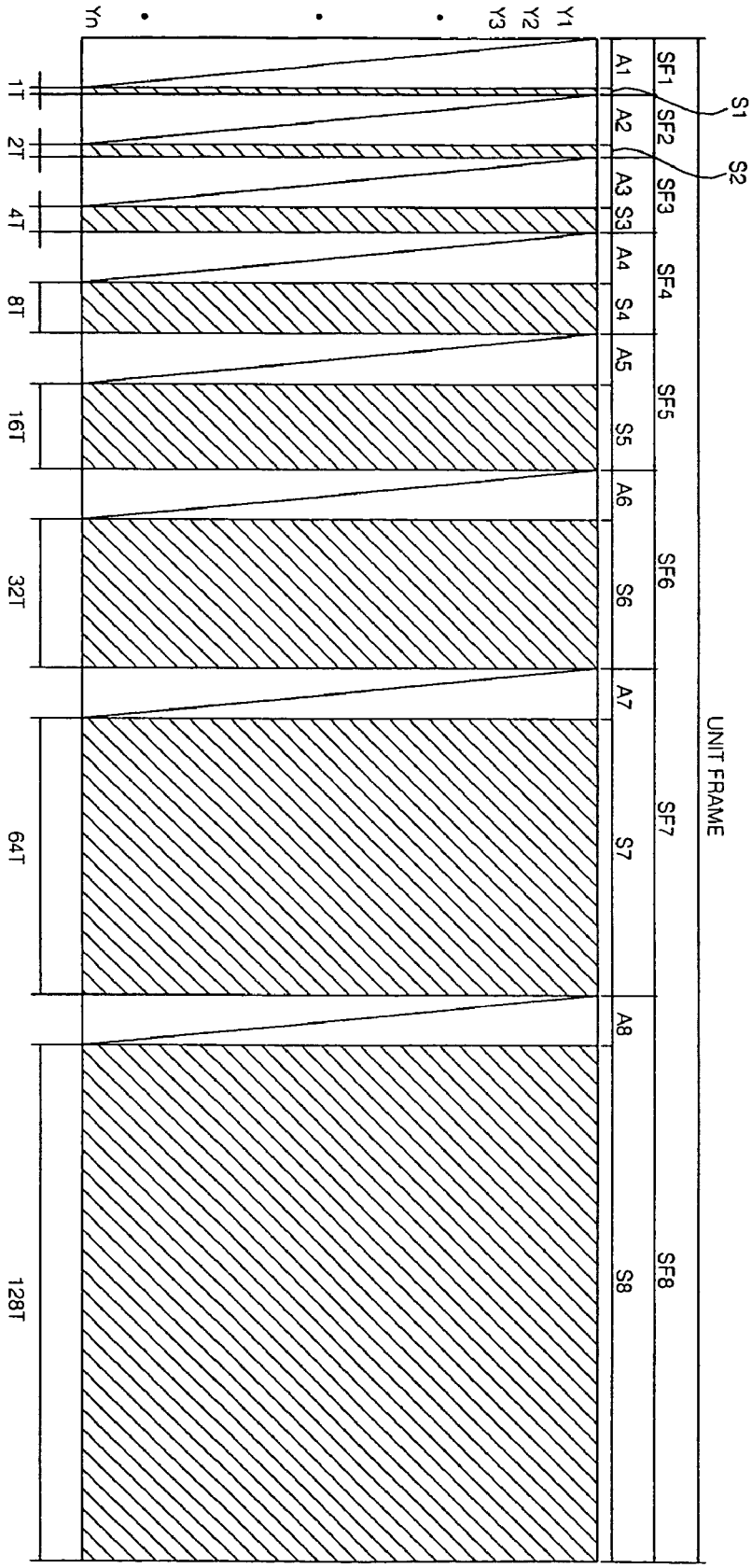
FIG. 3 is a timing diagram illustrating a method for dividing one frame into a plurality of subfields, and time-division driving a plasma display panel according to an exemplary embodiment of the present invention.

FIG. 3 is a timing diagram illustrating a method for dividing one frame into a plurality of subfields, and time-division driving the plasma display panel according to an exemplary embodiment of the present invention. A unit frame can be divided into a predetermined number of subfields, for example, eight subfields (SF1, . . . , SF8) to realize a time-division g ray level expression. Each subfield (SF1, . . . , SF8) is divided into a reset period (not shown), an address period (A1, . . . , A8), and a sustain period (S1, . . . , S8).

In each address period (A1, . . . , A8), a display data signal is supplied to the address electrode (X), and a corresponding scan pulse is sequentially supplied to each scan electrode (Y).

In each sustain period (S1, . . . , S8), a sustain pulse is alternately to the scan electrode (Y) and a sustain electrode (Z), and a sustain discharge is induced in the discharge cells where wall charges are formed in the address period (A1, . . . , A8).

A luminance of the plasma display panel is proportional to the number of sustain discharge pulses within a sustain discharge period (S1, . . . , S8) of the unit frame. In case where one frame forming one image is expressed by eight subfields and 256 gray levels, the number of the sustain charge pulses different from each other can be sequentially assigned in a ratio of 1:2:4:8:16:32:64:128 in each subfield. In order to obtain a luminance of 133 gray levels, the discharge cells are addressed during the subfield 1, the subfield 3, and the subfield 8, and the sustain discharge is performed.

The number of the sustain discharges assigned in each subfield can be variably decided depending on weight values of the subfields based on an automatic power control (APC) step. In other words, FIG. 3 exemplifies a case where one frame is divided into the eight subfields, but is not intended to limit a scope of the present invention. It is possible to variously change the number of the subfields forming one frame depending on a design specification. For example, one frame can be divided into more or less of eight subfields like twelve or sixteen subfields, and the plasma display panel can be driven.

It is possible to variously change the number of the sustain discharge pulses assigned in each subfield in consideration of a gamma characteristic or a panel characteristic. For example, a gray level assigned in the subfield 4 can decrease from 8 to 6, and a gray level assigned in the subfield 6 can increase from 32 to 34.

Figure 4:
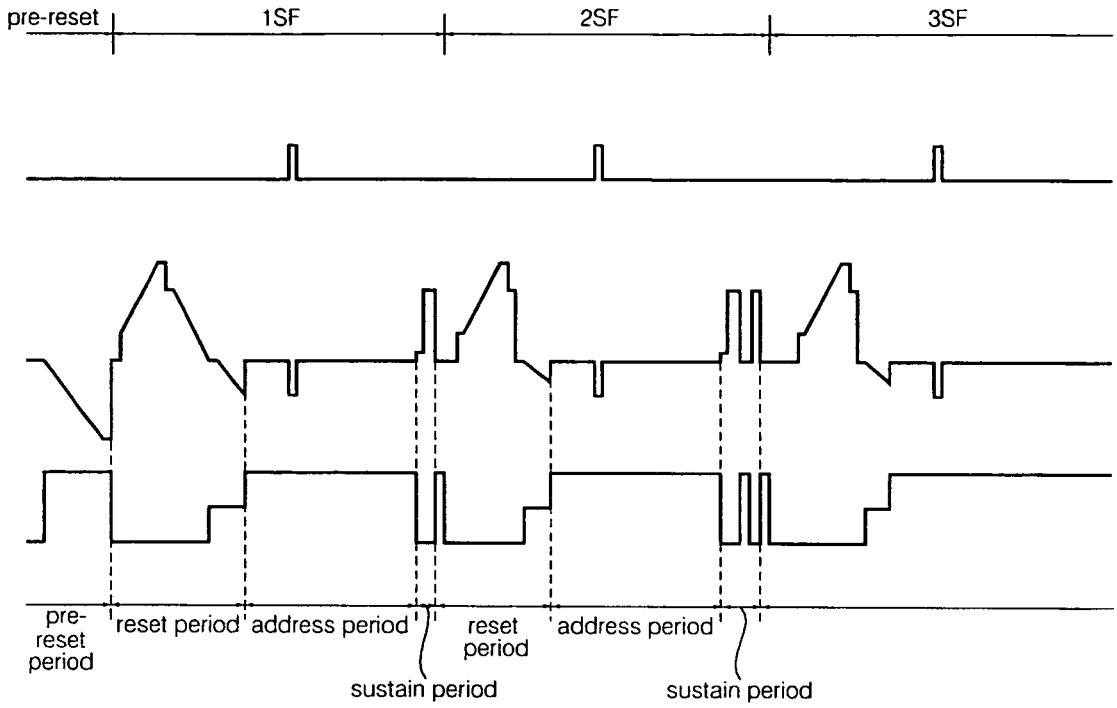
FIG. 4 is a timing diagram illustrating driving signals for driving a plasma display panel according to an exemplary embodiment of the present invention.

FIG. 4 is a timing diagram illustrating driving signals for driving the plasma display panel during the divided subfield according to an exemplary embodiment of the present invention.

Each subfield includes a pre reset period for forming positive wall charges on the scan electrodes (Y) and forming negative wall charges on the sustain electrodes (Z); a reset period for initializing the discharge cells of a whole screen using a distribution of the wall charges formed during the pre reset period; an address period for selecting the discharge cell; and a sustain period for sustaining a discharge of the selected discharge cell.

The reset period is comprised of a setup period and a setdown period. In the setup period, a ramp-up waveform is simultaneously supplied to all the scan electrodes, thereby inducing a minute discharge in all the discharge cells and thus, generating the wall charges. In the setdown period, a ramp-down waveform falling at a positive voltage lower than a peak voltage of the ramp-up waveform is simultaneously supplied to all the scan electrodes (Y), thereby inducing an erase discharge in all the discharge cells and thus, erasing unnecessary ones of the wall charges and space charges generated by a setup discharge.

In the address period, a negative scan signal is sequentially supplied to the scan electrode and at the same time, a positive data signal is supplied to the address electrode (X). By a voltage difference between the scan signal and the data signal, and a wall voltage generated during the reset period, the address discharge is induced and the cell is selected. During the setdown period and the address period, a signal sustaining a sustain voltage (Vs) is supplied to the sustain electrode.

In the sustain period, the sustain pulse is alternately supplied to the scan electrode and the sustain electrode, and the sustain discharge is induced between the scan electrode and the sustain electrode in a surface discharge type.

In FIG. 4, driving waveforms are signals for driving the plasma display panel according to one exemplary embodiment of the present invention. The driving waveforms of FIG. 4 are not intended to limit the scope of the present invention. For example, the pre reset period can be omitted, and polarities and voltage levels of the driving signals of FIG. 4 can vary according to need, and an erase signal for erasing the wall charges after completion of the sustain discharge can be supplied to the sustain electrode. Possible is also single sustain driving in which the sustain signal is supplied only to either the scan electrode (Y) or the sustain electrode (Z), thereby inducing the sustain discharge.

Figure 5:
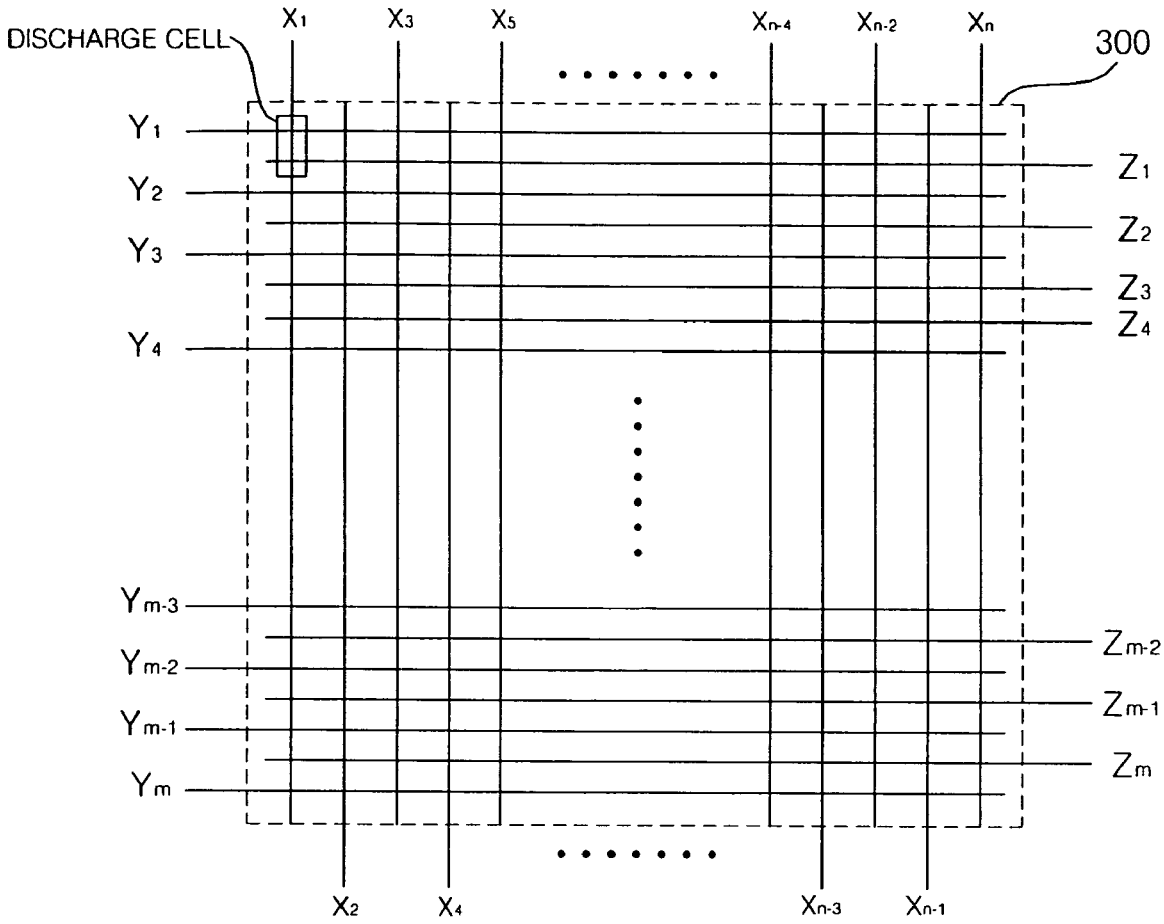
FIG. 5 is a diagram illustrating an electrode arrangement of a plasma display panel according to a first exemplary embodiment of the present invention.

FIG. 5 is a diagram illustrating an electrode arrangement of the plasma display panel according to a first exemplary embodiment of the present invention. It is desirable that a plurality of the discharge cells constituting the plasma display panel is disposed in matrix within an effective region 300. The discharge cells are provided at intersections of the scan electrodes ($Y_1$ to $Y_m$), the sustain electrodes ($Z_1$ to $Z_m$), and the address electrodes ($X_1$ to $X_n$). The scan electrodes ($Y_1$ to $Y_m$) are sequentially driven, and the sustain electrodes ($Z_1$ to $Z_m$) are commonly driven. As the driving signals are supplied to the scan electrodes ($Y_1$ to $Y_m$), the sustain electrodes ($Z_1$ to $Z_m$), and the address electrodes ($X_1$ to $X_n$) within the effective region 300, the discharge is induced in the discharge cells and an image is displayed. Electrodes can be disposed even outside the effective region 300. However, the electrode disposed outside the effective region 300 is a dummy electrode not having a bad influence on the display image.

As shown in FIG. 5, it is desirable that the address electrodes ($X_1$ to $X_n$) are divided into odd-numbered lines and even-numbered lines, and are driven.

As shown in FIG. 5, the scan electrodes ($Y_1$ and $Y_m$) are arranged in upper and lower outermosts of the effective region 300 of the plasma display panel according to the present invention. The scan electrode and the sustain electrode are alternately arranged. In order to arrange the scan electrodes ($Y_1$ and $Y_m$) in the outermosts according to the present invention, two sustain electrodes (Z3 and Z4) need to be sequentially arranged in least one portion. In other words, as shown in FIG. 5, as two sustain electrodes (Z3 and Z4) are sequentially arranged, the scan electrodes ($Y_1$ and $Y_m$) can be arranged in the upper and lower outermosts of the plasma display panel.

As described above, the scan electrodes ($Y_1$ and $Y_m$) are all arranged in the upper and lower outermosts of the plasma display panel, thereby preventing an abnormal discharge from being caused by accumulated charged particles as the sustain electrode (Z) is disposed in the outermost.

Figure 6:
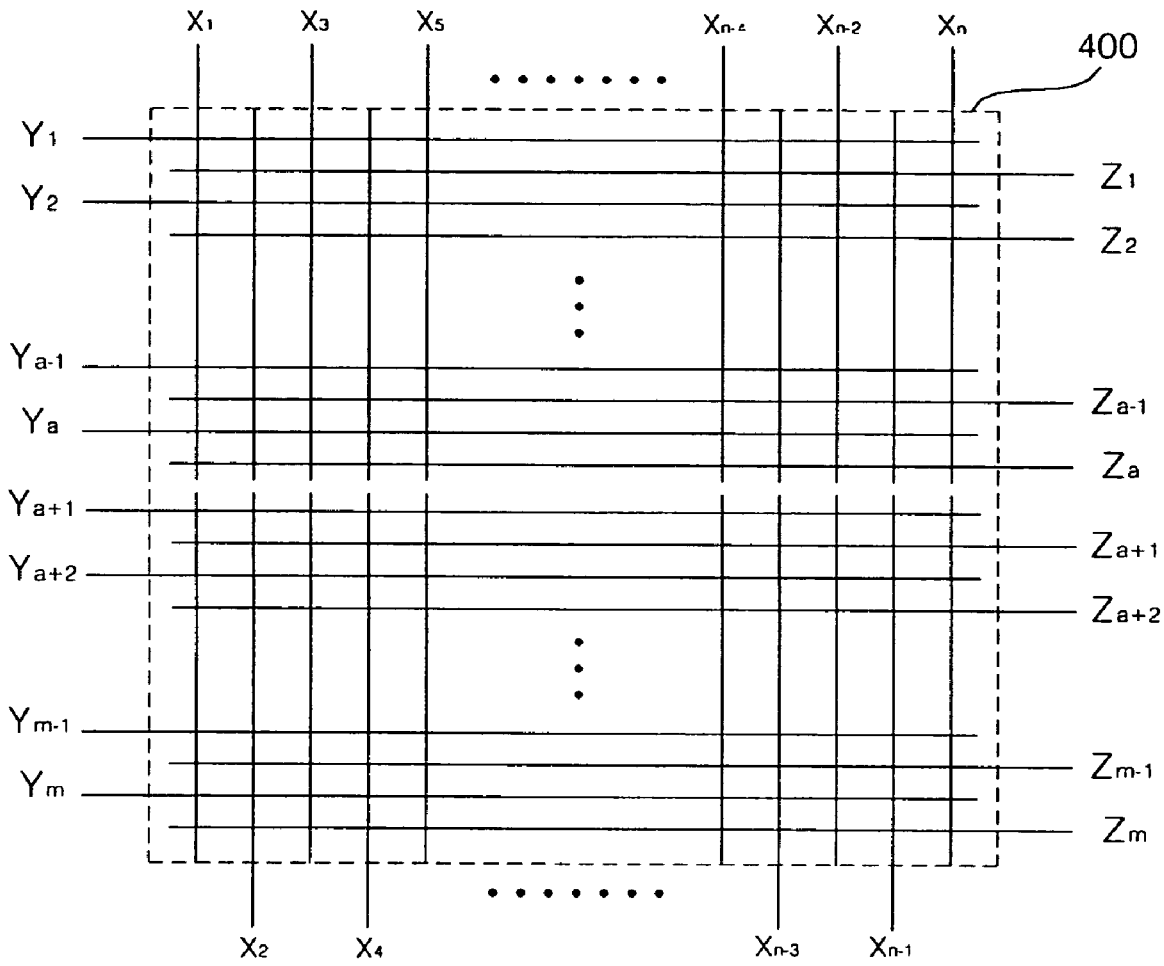
FIG. 6 is a diagram illustrating an electrode arrangement of a plasma display panel according to a second exemplary embodiment of the present invention.

FIG. 6 is a diagram illustrating an electrode arrangement of a plasma display panel according to a second exemplary embodiment of the present invention. In FIG. 6, address electrodes ($X_1$ to $X_n$) are separated at a center of the plasma display panel. As shown in FIG. 6, it is desirable that the address electrodes are up/down separated and driven. Thus, a very large amount of image data can be effectively processed. The address electrode ($X_1$ to $X_n$) can be separated as three or more electrodes.

In case where the address electrodes ($X_1$ to $X_n$) are up/down separated as shown in FIG. 6, the data signal is concurrently supplied to the upper address electrodes and the lower address electrodes centering on the center of the plasma display panel. Thus, the address discharge is concurrently induced in any one of the upper discharge cells and any one of the lower discharge cells, thereby increasing a period of the sustain pulse.

In a method for separating the address electrodes ($X_1$ to $X_n$) at the center of the plasma display panel, it is desirable to separate the address electrodes ($X_1$ to $X_n$) by the horizontal barrier rib 212*b* at the center of the plasma display panel, or separate each of the address electrodes ($X_1$ to $X_n$) at the time of forming the address electrodes. In other words, there is not the dielectric layer on the address electrode separated by the horizontal barrier rib 212*b* at the center of the plasma display panel whereas, there is the dielectric layer on a separated portion of the address electrode in case where the address electrode is separated at the time of forming the address electrode.

It is desirable that a gap between the address electrodes separated at the center of the plasma display panel is about 70 μm to 220 μm. The separated gap of about 70 μm to 220 μm between the two address electrodes is desirable for improving an erroneous discharge and improving a bright defect. The address electrode can have an angular shape at its terminal of the separated portion, but can have a curved shape to have a predetermined curvature so as to improve the erroneous discharge.

Figure 7:
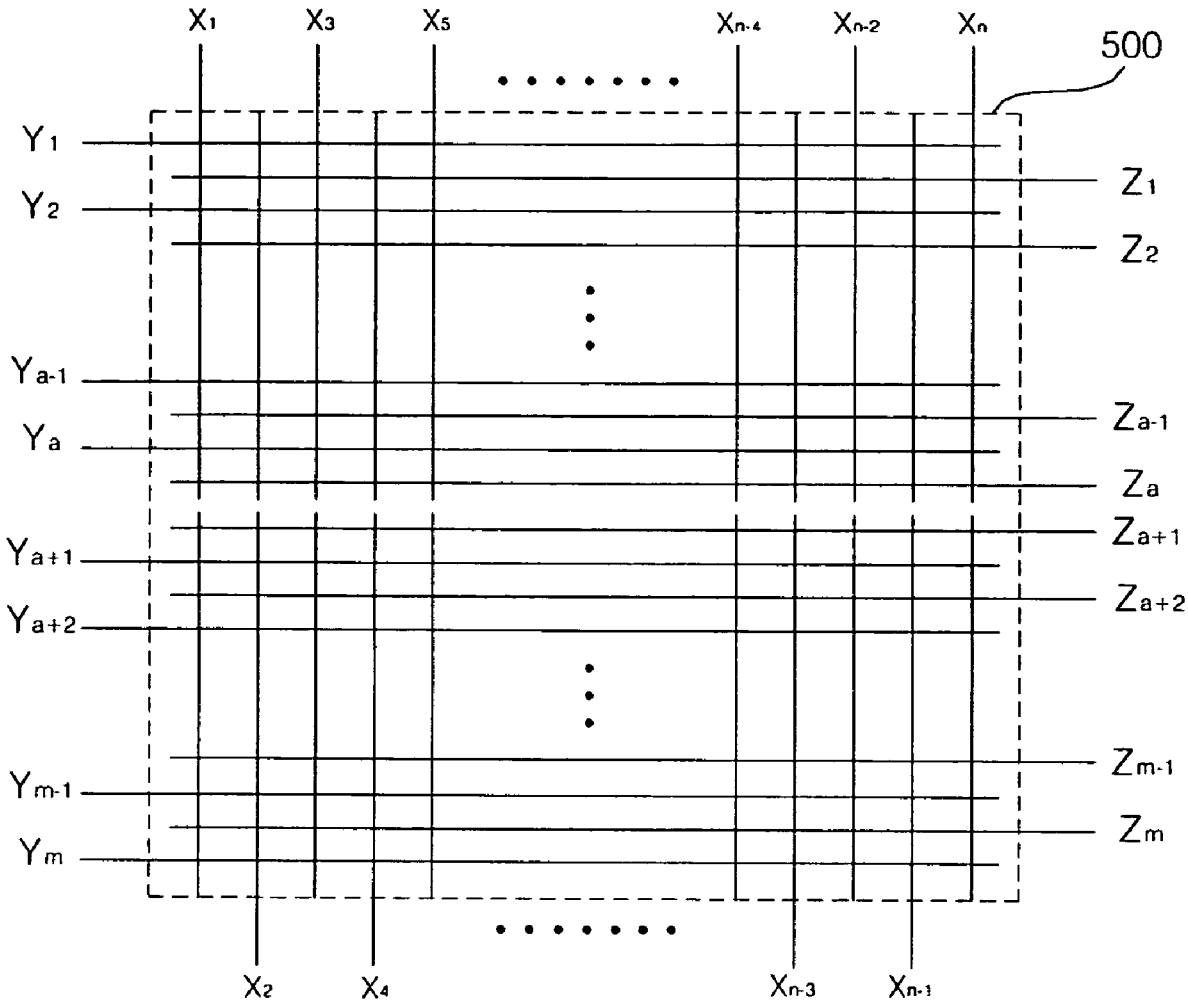
FIG. 7 is a diagram illustrating an electrode arrangement of a plasma display panel according to a third exemplary embodiment of the present invention.

FIG. 7 is a diagram illustrating an electrode arrangement of a plasma display panel according to a third exemplary embodiment of the present invention. As shown in FIG. 7, it is desirable that scan electrodes ($Y_1$ and $Y_m$) are disposed in upper and lower outermosts of an effective region 500 of the plasma display panel, and all two electrodes adjacent to a center of the plasma display panel where address electrodes ($X_1$ to $X_n$) are separated are sustain electrodes ($Z_a$ and $Z_{a+1}$). As shown in FIG. 7, the sustain electrodes ($Z_a$ and $Z_{a+1}$) can be disposed adjacently to the center of the plasma display panel, thereby preventing an abnormal discharge from being induced due to an accumulation of charged particles. It is also possible that two electrodes separated at the center of the plasma display panel all are scan electrodes in a panel structure for dual scan driving according to an exemplary embodiment of the present invention.

Figure 8:
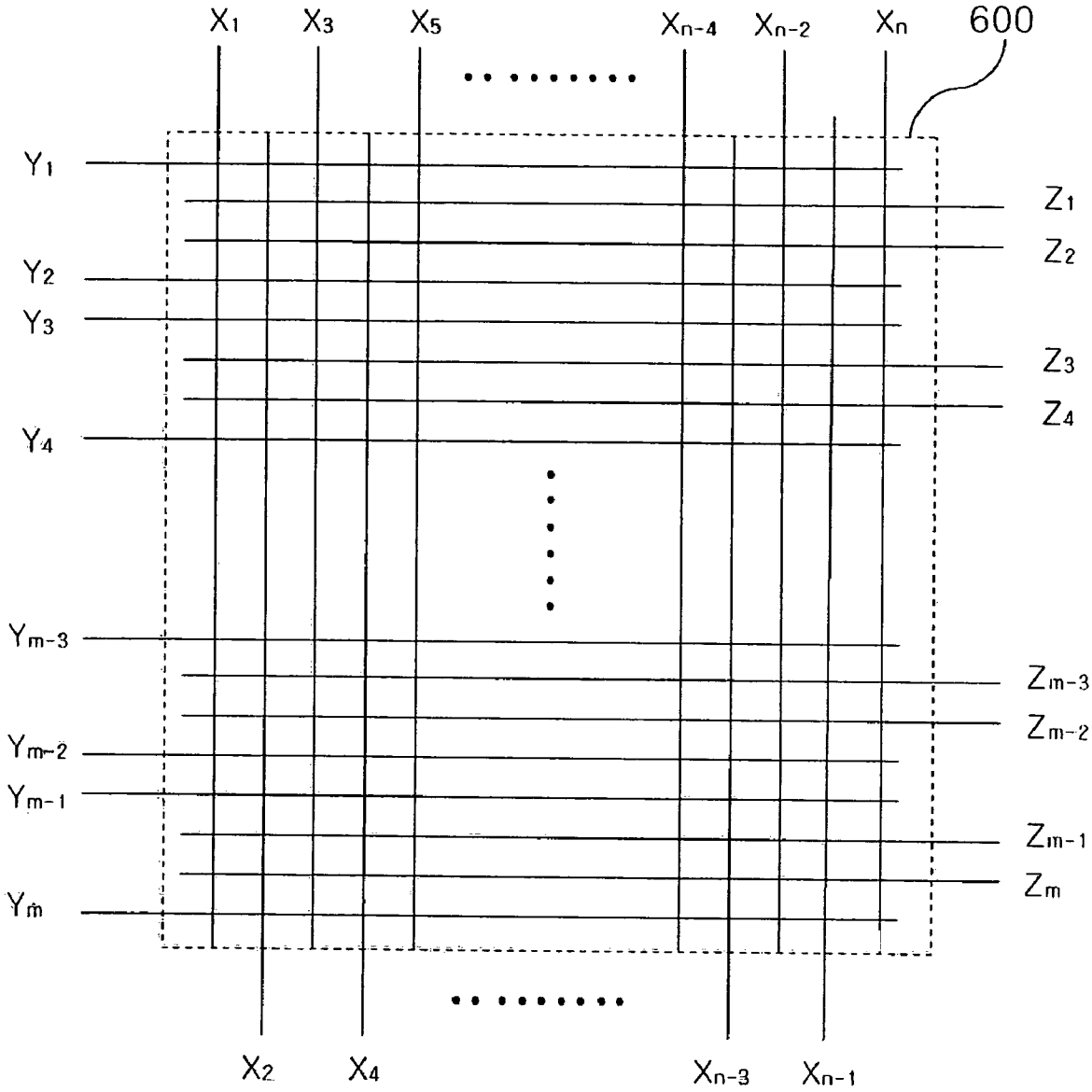
FIG. 8 is a diagram illustrating an electrode arrangement of a plasma display panel according to a fourth exemplary embodiment of the present invention.

FIG. 8 is a diagram illustrating an electrode arrangement of a plasma display panel according to a fourth exemplary embodiment of the present invention. As shown in FIG. 8, scan electrodes ($Y_1$ and $Y_m$) can be disposed in upper and lower outermosts of an effective region 600 of the plasma display panel, and two adjacent sustain electrodes can be sequentially disposed.

Figure 9:
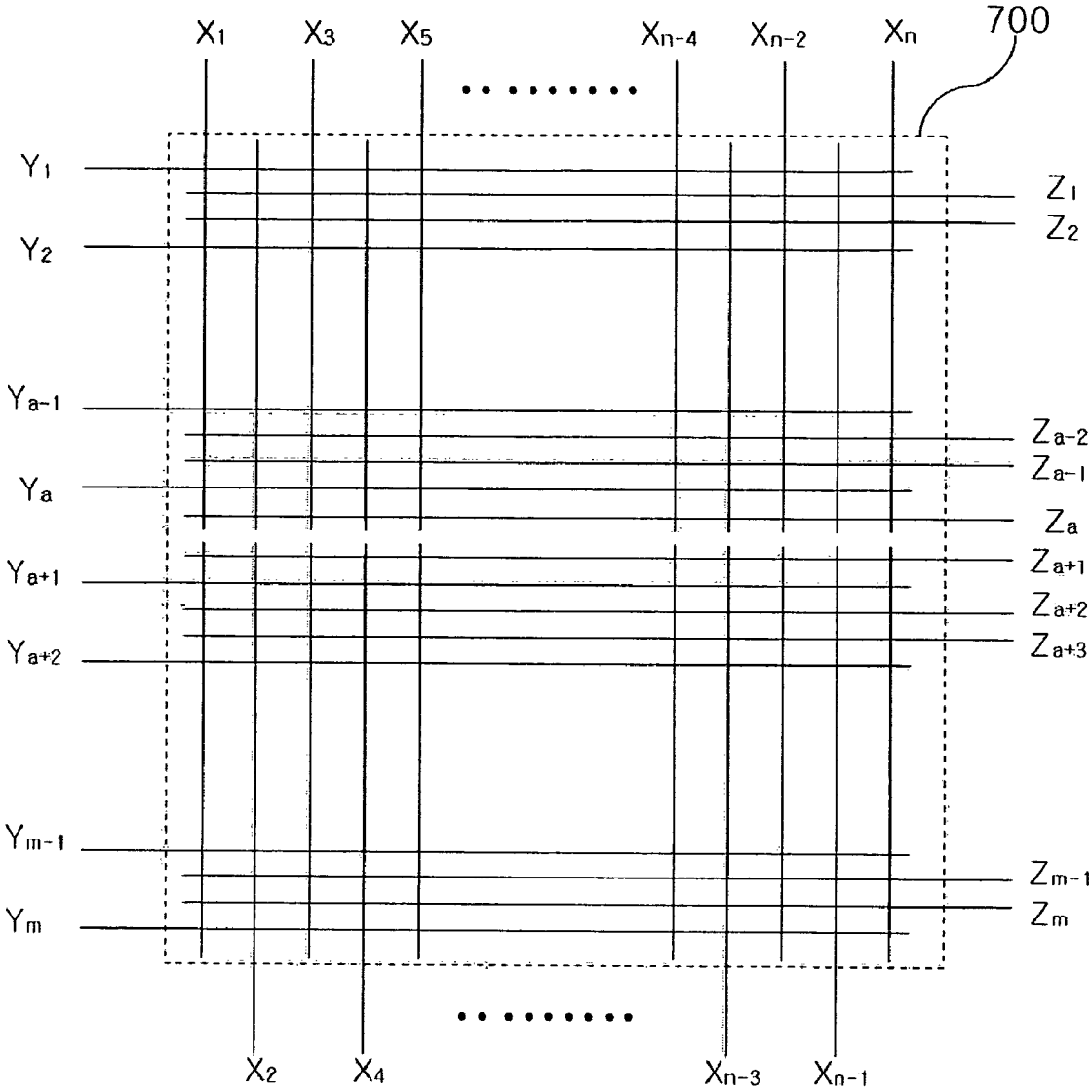
FIG. 9 is a diagram illustrating an electrode arrangement of a plasma display panel according to a fifth exemplary embodiment of the present invention.

FIG. 9 is a diagram illustrating an electrode arrangement of a plasma display panel according to a fifth exemplary embodiment of the present invention. The arrangement of a scan electrode and a sustain electrode has a YZZY structure as in FIG. 8, and address electrodes ($X_1$ to $X_n$) can be separated at a center of an effective region 700. As shown in FIG. 9, electrodes adjacent to the center of the effective region 700 where the address electrodes ($X_1$ to $X_n$) are separated can be sustain electrodes ($Z_a$ and $Z_{a+1}$). Unlike this, the scan electrode can be also provided adjacently to the center of the effective region 700 where the address electrodes ($X_1$ to $X_n$) are separated.

The above description is made for the electrode arrangement of the plasma display panel according to the present invention on the basis of an exemplary structure in which each of the address electrodes ($X_1$ to $X_n$) is separated into two electrodes. However, each of the address electrodes ($X_1$ to $X_n$) can be also separated into three or more electrodes.

In the plasma display panel according to an exemplary embodiment of the present invention, one or more dummy cell lines can be formed outside the effective region for displaying a screen. The dummy cell line can be formed in a horizontal direction or in a vertical direction. A dummy electrode having a shape equal to or different from that of the discharge cell formed in the effective region can be formed in a dummy cell, and a predetermined voltage can be supplied to the dummy cell.

Figure 10A:
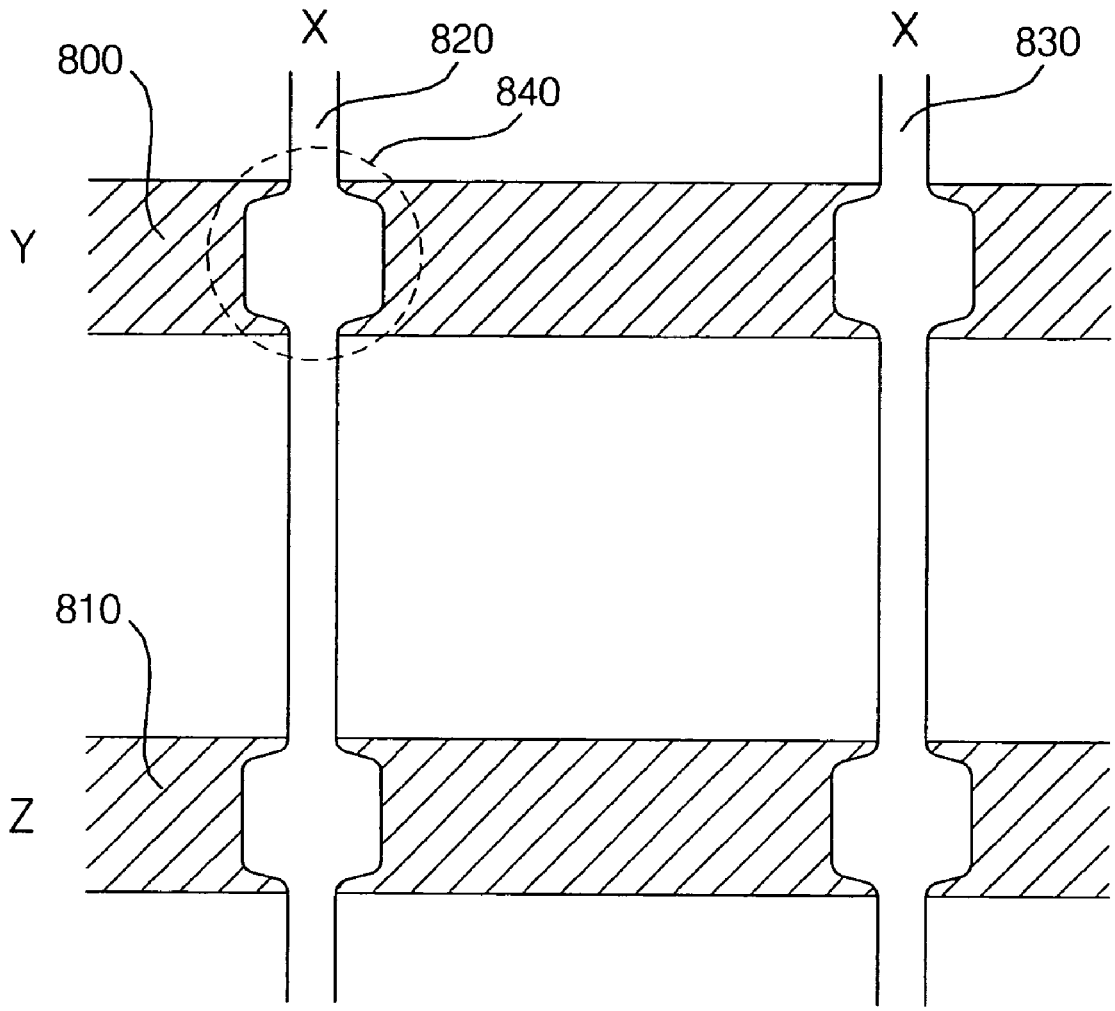
FIGS. 10A and 10B are cross-sectional views illustrating an address electrode shape of a plasma display panel according to exemplary embodiments of the present invention.

FIG. 10A is a cross-sectional view illustrating an address electrode shape of a plasma display panel according to the present invention. As shown in FIG. 10A, a portion 840 of an address electrode (X) 820 or 830 intersecting with a scan electrode (Y) 800 or a sustain electrode (Z) 810 can have a greater width than other portions. FIG. 10A merely is an exemplary embodiment of the address electrode shape according to the present invention. Therefore, unlike FIG. 10A, the portion 840 of the address electrode (X) 820 or 830 intersecting with the scan electrode (Y) 800 or the sustain electrode (Z) 810 can be different in shape. The portion 840 of the address electrode (X) 820 or 830 intersecting with the scan electrode (Y) 800 or the sustain electrode (Z) 810 can be of all shapes so far as it partially has a greater width than the other portions.

Figure 10B:
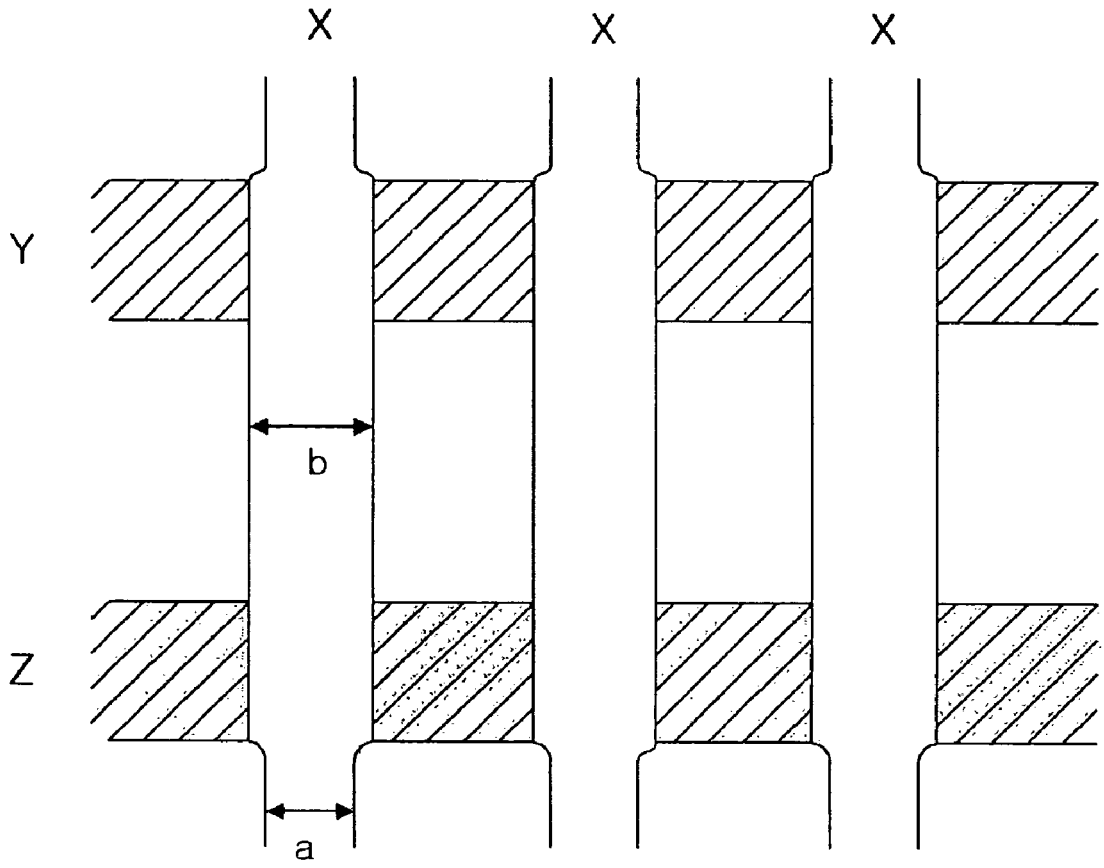

FIG. 10B is a cross-sectional view illustrating an address electrode shape of a plasma display panel according to an exemplary embodiment of the present invention. As shown in FIG. 10B, a width (b) of a portion of an address electrode (X) intersecting with a scan electrode (Y) or a sustain electrode (Z) can be greater than a width (a) of other portions thereof.

It is desirable that the width (b) of the portion of the address electrode (X) intersecting with the scan electrode (Y) or the sustain electrode (Z) is 1.2 times or 1.5 times of the width (a) of the other portions thereof. The above range can improve an efficiency of an address discharge.

Figure 11:
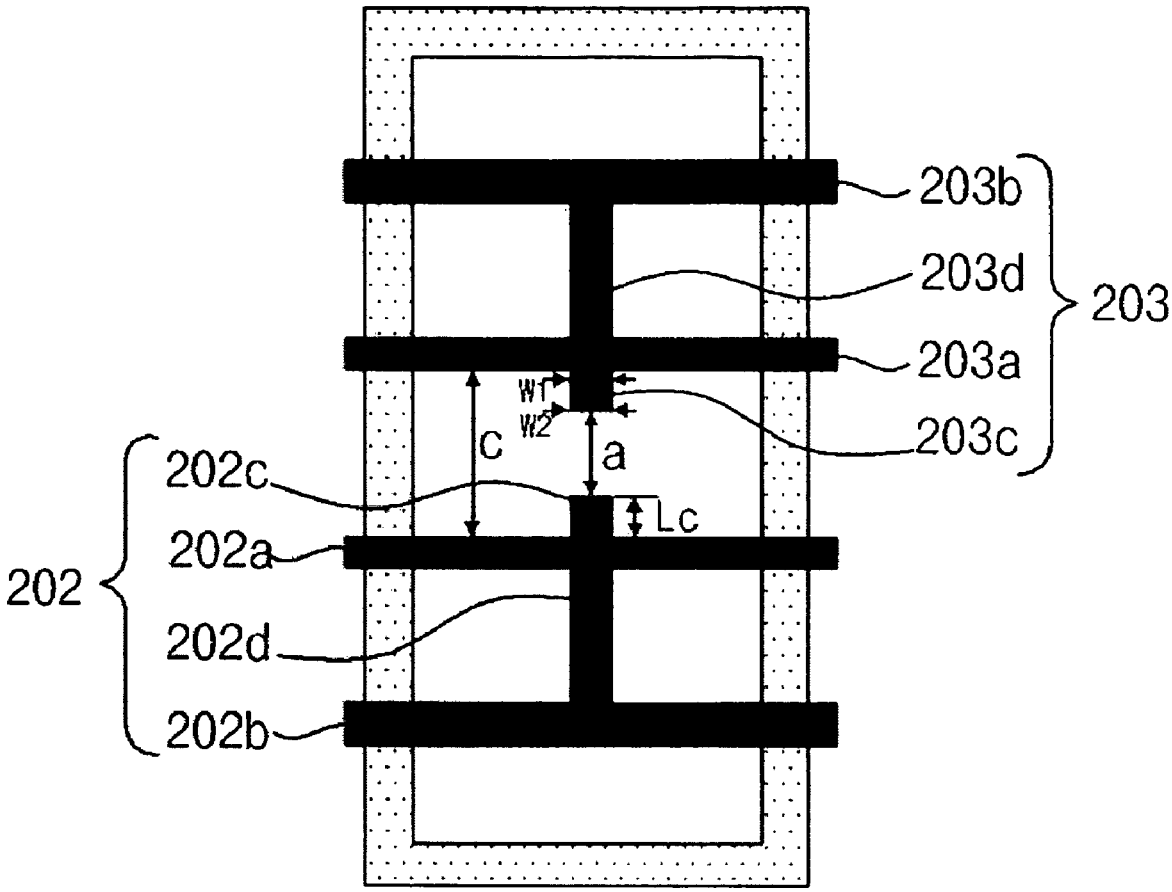
FIG. 11 is a cross-sectional view illustrating a sustain electrode structure according to a first exemplary embodiment of the present invention.

FIG. 11 is a cross-sectional view illustrating a sustain electrode structure according to a first exemplary embodiment of the present invention. FIG. 11 illustrates only a simple arrangement structure of a sustain electrode pair 202 and 203 that is formed within one discharge cell of the plasma display panel shown in FIG. 2.

As shown in FIG. 11, sustain electrodes 202 and 203 are symmetrically paired on the basis of a center of a discharge cell on a substrate according to the first exemplary embodiment of the present invention. Each sustain electrode includes a line part, and a protrusion part. The line part includes at least two electrode lines 202*a* and 202*b*, or 203*a* and 203*b* crossing the discharge cell. The protrusion part includes at least one protrusion electrode 202*c* or 203*c* connecting to the electrode line 202*a* or 203*a* closest to the center of the discharge cell, and protruding in the direction of the center of the discharge cell within the discharge cell. As shown in FIG. 11, it is desirable that each of the sustain electrodes 202 and 203 further includes one bridge electrode 202*d* or 203*d* for connecting the two electrode lines 202*a* and 202*b*, or 203*a* and 203*b*.

The electrode lines 202*a* and 202*b*, and 203*a* and 203*b* cross the discharge cell, and extend in one direction of the plasma display panel. According to the first exemplary embodiment of the present invention, the electrode line is narrowed in width to improve an aperture ratio. A plurality of the electrode lines 202*a*, 202*b*, and 203*a*, 203*b* is used for improving a discharge diffusion efficiency. It is desirable to decide the number of the electrode lines in consideration of the aperture ratio.

It is desirable that the protrusion electrodes 202*c* and 203*c* connect to the electrode lines 202*a* and 203*a* closest to the center of the discharge cell within one discharge cell, and protrude in the direction of the center of the discharge cell. The protrusion electrodes 202*c* and 203*c* reduce a discharge initiation voltage when the plasma display panel is driven. By a distance (C) between the electrode lines 202*a* and 203*a*, the discharge initiation voltage increases and therefore, each of the electrode lines 202*a* and 203*a* has the protrusion electrode 202*c* or 203*c* connecting thereto in the first exemplary embodiment of the present invention. The discharge is initiated owing to even a low discharge initiation voltage between the protrusion electrodes 202*c* and 203*c* provided closely and therefore, the discharge initiation voltage of the plasma display panel can be lowered. The discharge initiation voltage refers to a voltage level where the discharge is initiated when a pulse is supplied to any one of the sustain electrode pair 202 and 203.

Since the protrusion electrodes 202*c* and 203*c* are of a very small size, a width (W1) of a protrusion electrode portion connecting with the electrode line 202*a* or 203*a* may be substantially greater than a width (W2) of a protrusion electrode end portion by a manufacture tolerance. According to need, it is also possible to provide the width (W2) of the protrusion electrode end portion greater.

The bridge electrodes 202*d* and 203*d* connect the two electrode lines 202*a*, 202*b*, and 203*a*, 203*b* constituting each of the sustain electrodes 202 and 203. The bridge electrodes 202*d* and 203*d* help the discharge initiated by the protrusion electrodes 202*c* and 203*c* to easily diffuse to the electrode lines 202*b* and 203*b* distant away from the center of the discharge cell.

As above, the electrode structure according to the first exemplary embodiment of the present invention can suggest the number of the electrode lines, thereby improving the aperture ratio. The protrusion electrodes 202*c* and 203*c* can be formed, thereby lowering the discharge initiation voltage. By the bridge electrodes 202*d* and 203*d* and the electrode lines 202*b* and 203*b* distant away from the center of the discharge cell, the discharge diffusion efficiency can increase, thereby totally improving a light emission efficiency of the plasma display panel. In other words, the inventive plasma display panel can be equal to or brighter than a conventional plasma display panel and thus, is possible not to use a transparent ITO electrode.

Figure 12:
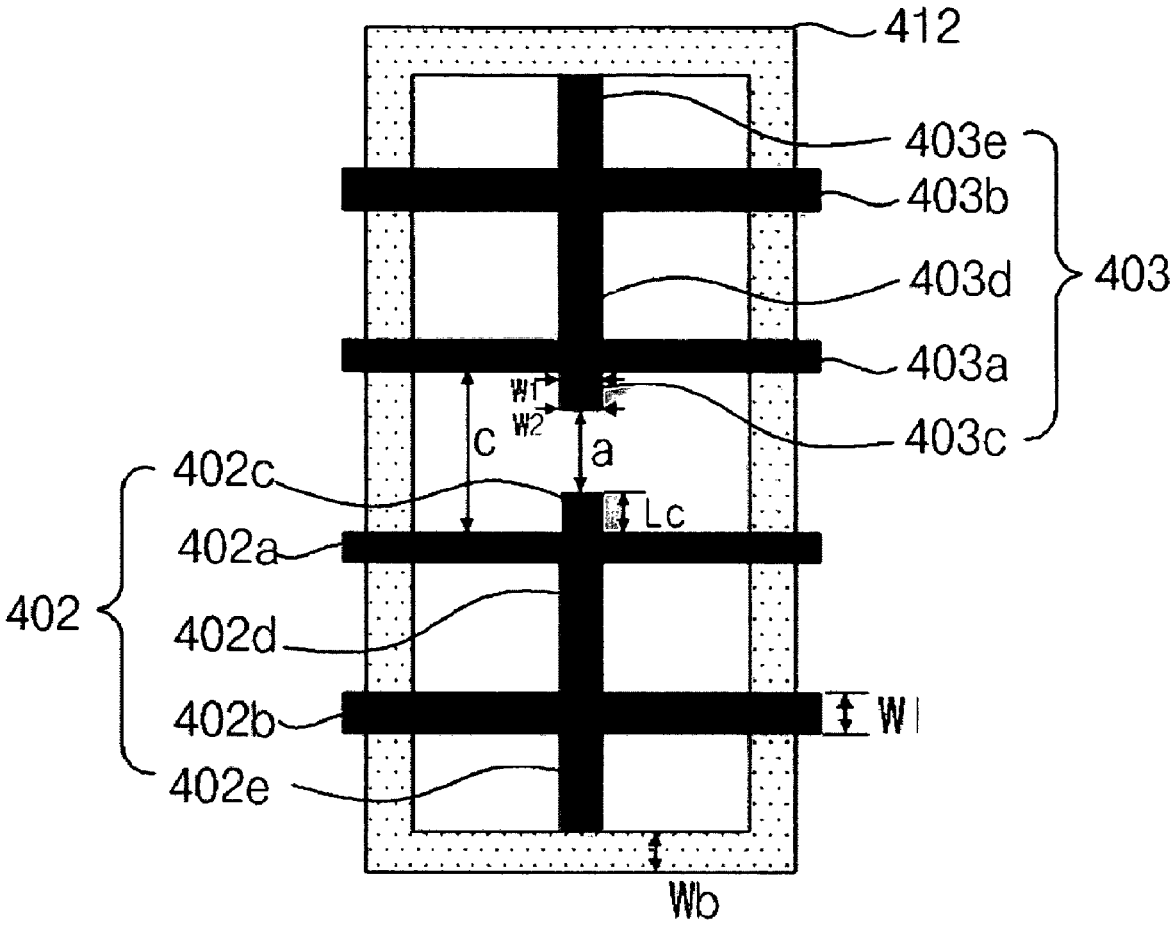
FIG. 12 is a cross-sectional view illustrating a sustain electrode structure according to a second exemplary embodiment of the present invention.

FIG. 12 is a cross-sectional view illustrating a sustain electrode structure according to a second exemplary embodiment of the present invention. FIG. 12 illustrates only a simple arrangement structure of a sustain electrode pair 402 and 403 that is formed within one discharge cell of the plasma display panel shown in FIG. 2.

As shown in FIG. 12, each of sustain electrodes 402 and 403 includes at least two electrode lines 402*a*, 402*b*, and 403*a*, 403*b* crossing a discharge cell; first protrusion electrodes 402*c* and 403*c* connecting to the electrode lines 402*a* and 403*a* closest to a center of the discharge cell and protruding in the direction of the center of the discharge cell within the discharge cell; bridge electrodes 402*d* and 403*d* connecting the two electrode lines 402*a*, 402*b*, and 403*a*, 403*b*; and second protrusion electrodes 402e and 403e connecting to the electrode lines 402*b* and 403*b* most distant away from the center of the discharge cell and protruding in an opposite direction of the center of the discharge cell within the discharge cell.

The electrode lines 402*a*, 402*b*, and 403*a*, 403*b* cross the discharge cell, and extend in one direction of the plasma display panel. It is desirable that the sustain electrode line is narrowed in width to improve the aperture ratio according to the second exemplary embodiment of the present invention. It is desirable that the electrode line has a width (W1) of about 20 μm to 70 μm, thereby improving the aperture ratio and smoothly inducing the discharge.

As shown in FIG. 12, the electrode lines 402*a* and 403*a* closest to the center of the discharge cell connect with the first protrusion electrodes 402*c* and 403*c*. The electrode lines 402*a* and 403*a* closest to the center of the discharge cell form a path where the discharge is initiated and at the same time, a discharge diffusion begins. The electrode lines 402*b* and 403*b* distant away from the center of the discharge cell connect with the second protrusion electrodes 402*e* and 403*e*. The electrode lines 402*b* and 403*b* distant away from the center of the discharge cell perform a function of diffusing the discharge up to a peripheral part of the discharge cell.

The first protrusion electrodes 402*c* and 403*c* connect to the electrode lines 402*a* and 403*a* closest to the center of the discharge cell within one discharge cell, and protrude in the direction of the center of the discharge cell. It is desirable that the first protrusion electrode is formed at the center of the electrode line 402*a* or 403*a*. The first protrusion electrodes 402*c* and 403*c* can be formed correspondingly to each other at the centers of the electrode lines 402*a* and 403*a*, thereby more effectively lowering the discharge initiation voltage of the plasma display panel.

The bridge electrodes 402*d* and 403*d* connect the two electrode lines 402*a*, 402*b*, and 403*a*, 403*b* constituting each of the sustain electrodes 402 and 403. The bridge electrodes 402*d* and 403*d* help the discharge initiated by the protrusion electrodes to easily diffuse to the electrode lines 402*b* and 403*b* distant away from the center of the discharge cell. The bridge electrodes 402*d* and 403*d* are positioned within the discharge cell, but can be also formed on a barrier rib 412 partitioning the discharge cell according to need.

Accordingly, in the sustain electrode structure of the plasma display panel according to the second exemplary embodiment of the present invention, the discharge can be diffused even to a space between the electrode lines 402*b* and 403*b* and the barrier rib 412. Thus, the discharge diffusion efficiency can increase, thereby improving the light emission efficiency of the plasma display panel.

As shown in FIG. 12, the second protrusion electrodes 402*e* and 403*e* can extend to the barrier rib 412 for partitioning the discharge cell. If the aperture ratio can be sufficiently compensated in other portions, it is also possible to extend the second protrusion electrodes 402*e* and 403*e* over the barrier rib 412 to more improve the discharge diffusion efficiency.

In the sustain electrode structure according to the second exemplary embodiment of the present invention, it is desirable that the second protrusion electrodes 402*c* and 403*c* are formed on the center of the electrode lines 402*b* and 403*b*, thereby uniformly diffusing the discharge to the peripheral part of the discharge cell.

Figure 13:
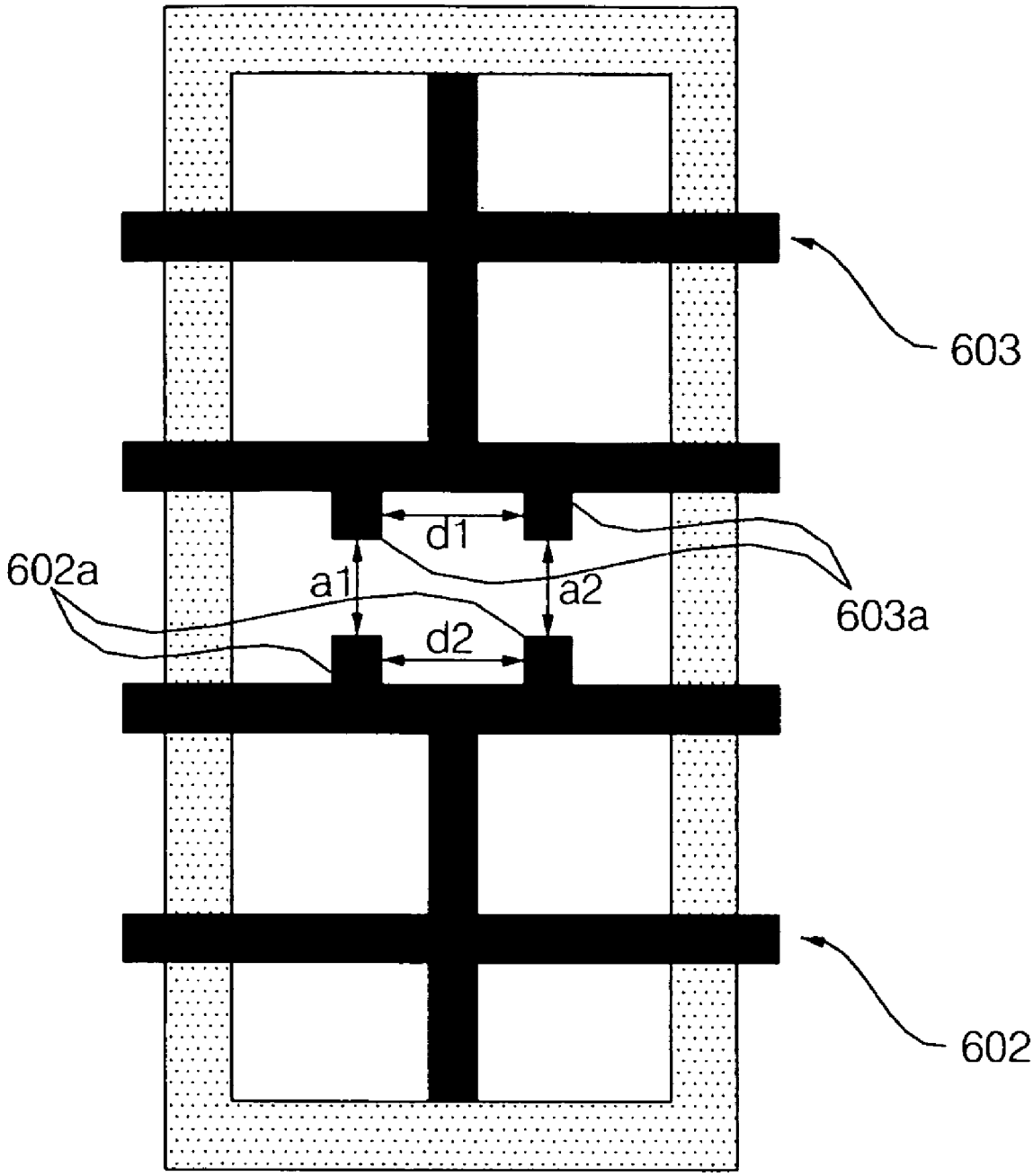
FIG. 13 is a cross-sectional view illustrating a sustain electrode structure according to a third exemplary embodiment of the present invention.

FIG. 13 is a cross-sectional view illustrating a sustain electrode structure according to a third exemplary embodiment of the present invention. A description of the same content of the sustain electrode structure of FIG. 13 as that of FIG. 12 will be omitted.

As shown in FIG. 13, in the sustain electrode structure according to the third exemplary embodiment of the present invention, two first protrusion electrodes 602*a* and 603*a* are formed at the sustain electrodes 602 and 603, respectively. The first protrusion electrodes 602*a* and 603*a* connect to a electrode line close to a center of a discharge cell, and protrude in the direction of the center of the discharge cell. It Is desirable that the first protrusion electrodes 602*a* and 603*a* are formed in symmetry with each other on the basis of a center of the electrode line.

The two first protrusion electrodes 602*a* and 603*a* are formed at the sustain electrodes 602 and 603, respectively, thereby increasing an electrode area at the center of the discharge cell. Accordingly, before the discharge is initiated, space charges are much formed within the discharge cell, thereby more reducing a discharge initiation voltage and making a discharge speed fast. After the discharge is initiated, an amount of wall charges increases, thereby increasing a luminance and uniformly diffusing the discharge in a whole discharge cell.

It is desirable that intervals (a1 and a2) between the first protrusion electrodes 602*a* and 603*a*, that is, intervals (a1 and a2) between two protrusion electrodes in the direction of intersecting with the electrode lines 602 and 603 are about 15 μm to 165 μm. Critical meanings of an upper limit value and a lower limit value of the interval between the protrusion electrodes are the same as those described with reference to FIG. 5 and thus, their descriptions will be omitted.

Figure 14:
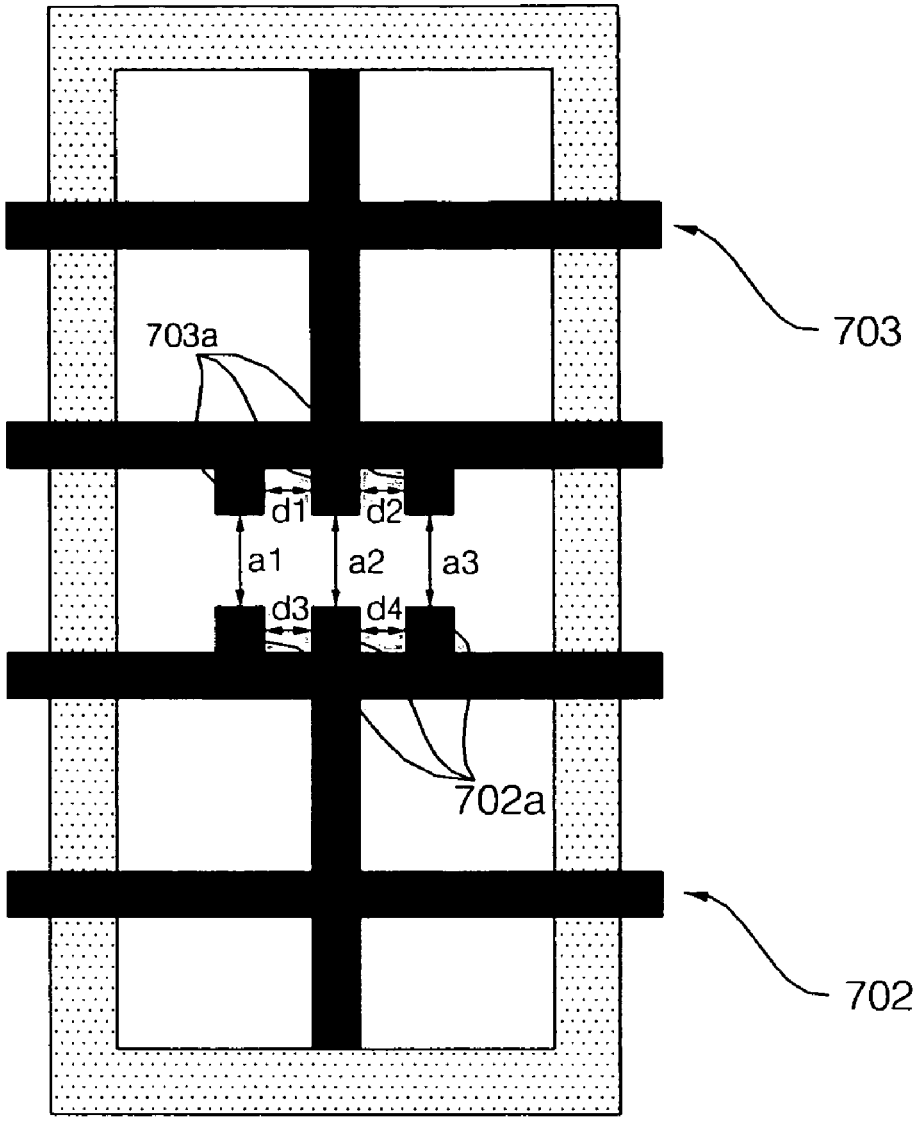
FIG. 14 is a cross-sectional view illustrating a sustain electrode structure according to a fourth exemplary embodiment of the present invention.

FIG. 14 is a cross-sectional view illustrating a sustain electrode structure according to a fourth exemplary embodiment of the present invention. A description of the same contents of the sustain electrode structure of FIG. 14 as those of the descriptions of FIGS. 12 and 13 will be omitted below.

As shown in FIG. 14, in the sustain electrode structure according to the fourth exemplary embodiment of the present invention, sustain electrodes 702 and 703 has three first protrusion electrodes 702*a* and 703*a*, respectively.

The first protrusion electrodes 702*a* and 703*a* connect to an electrode line close to a center of a discharge cell, and protrude in the direction of the center of the discharge cell. It is desirable that any one first protrusion electrode is formed at the center of the electrode line, and other two first protrusion electrodes are formed in symmetry with each other on the basis of a middle of the electrode line. The three first protrusion electrodes 702*a* and 703*a* are formed at the sustain electrodes 702 and 703, respectively, thereby reducing a discharge initiation voltage more than in FIG. 7 and making a discharge speed more fast. After the discharge is initiated, a luminance is more increased, and the discharge is more uniformly diffused in a whole discharge cell.

The number of the first protrusion electrodes is increased as above, thereby increasing an electrode area at the center of the discharge cell, lowering the discharge initiation voltage, and increasing the luminance. It should be considered that the strongest discharge is induced and the brightest discharge light is emitted at the center of the discharge cell. In other words, it is desirable that the number of the first protrusion electrodes is optimally selected and the sustain electrode structure is designed, considering, together with the discharge initiation voltage and the luminance efficiency, that the light emitted from the center of the discharge cell is much blocked and remarkably reduced as the number of the first protrusion electrodes increases.

Figure 15:
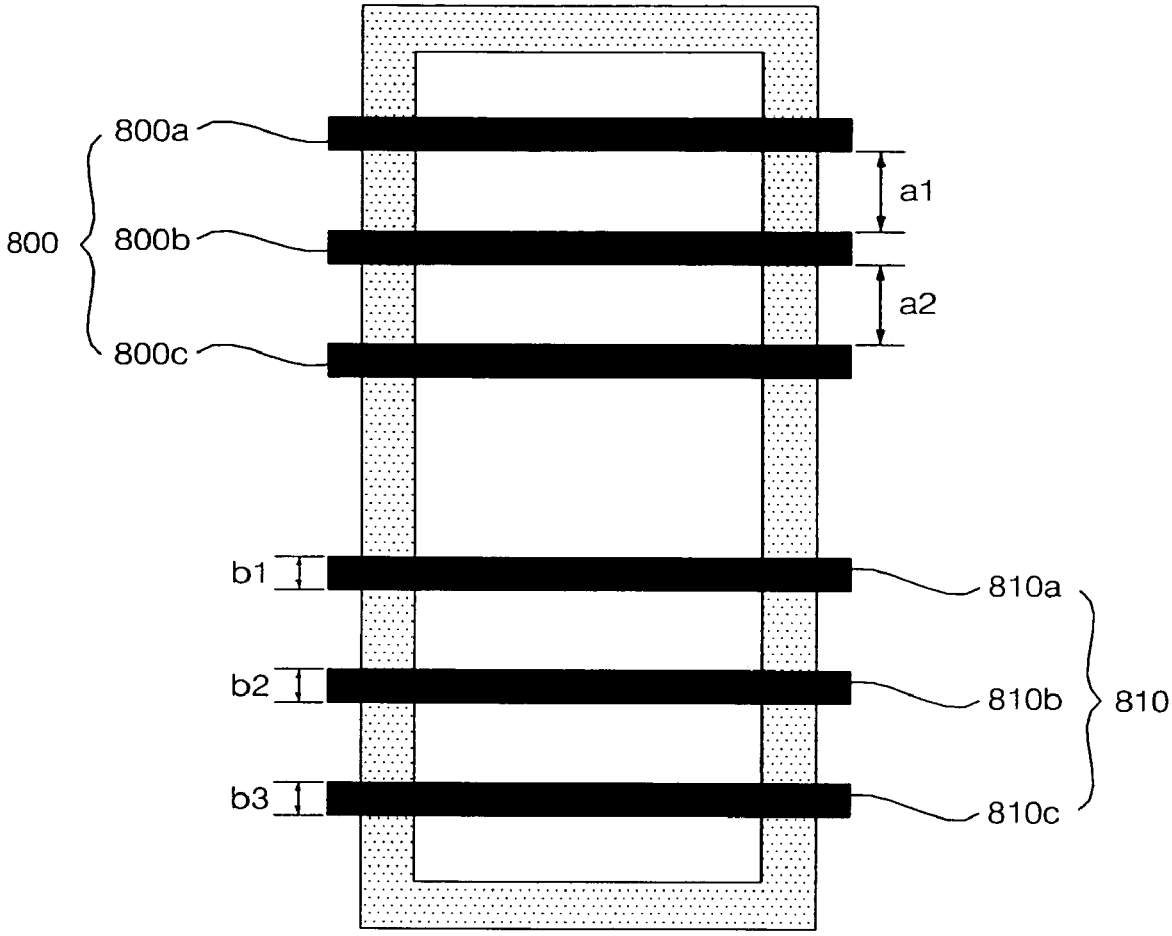
FIG. 15 is a cross-sectional view illustrating a sustain electrode structure according to a fifth exemplary embodiment of the present invention.

FIG. 15 is a cross-sectional view illustrating a sustain electrode structure according to a fifth exemplary embodiment of the present invention. Sustain electrodes 800 and 810 includes three electrode lines 800*a*, 800*b*, 800*c*, and 810*a*, 810*b*, 810*c* crossing a discharge cell, respectively. The electrode lines cross the discharge cell, and extend in one direction of the plasma display panel. The electrode lines are narrowed in width to improve an aperture ratio. It is desirable that the electrode line has a width of about 20 μm to 70 μm to improve the aperture ratio and together, smoothly induce a discharge.

It is desirable that the electrode lines 800*a*, 800*b*, 800*c*, and 810*a*, 810*b*, 810*c* of a sustain electrode pair have thicknesses of about 3 μm to 7 μm. Intervals (a1 and a2) between the three electrode lines constituting each of the sustain electrode can be equal to or different from each other. Even widths (b1, b2, and b3) of the electrode lines can be equal to or different from each other. Critical meanings of an upper limit value and a lower limit value of the thickness of the electrode line is the same as those described with reference to FIG. 2 and thus, their descriptions will be omitted.

Figure 16:
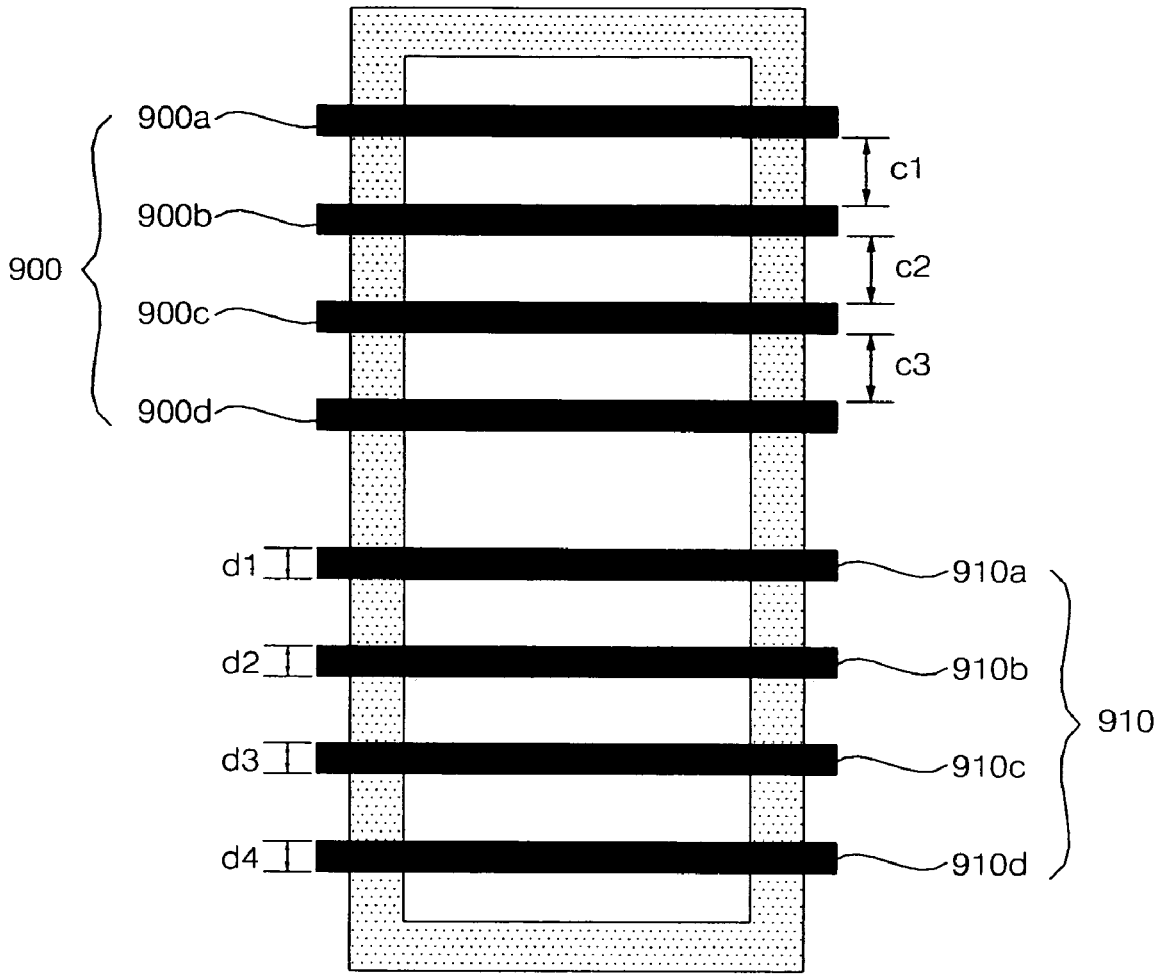
FIG. 16 is a cross-sectional view illustrating a sustain electrode structure according to a sixth exemplary embodiment of the present invention.

FIG. 16 is a cross-sectional view illustrating a sustain electrode structure according to a sixth exemplary embodiment of the present invention. Sustain electrodes 900 and 910 includes four electrode lines 900*a*, 900*b*, 900*c*, 900*d*, and 910*a*, 910*b*, 910*c*, 910*d* crossing a discharge cell, respectively. The electrode lines cross the discharge cell, and extend in one direction of the plasma display panel. The electrode lines are narrowed in width to improve an aperture ratio. It is desirable that the electrode lines have widths of 20 μm to 70 μm to improve the aperture ratio and together, smoothly induce a discharge.

Intervals (c1, c2, and c3) between the four electrode lines constituting each sustain electrode can be equal to or different from each other. Widths (d1, d2, d3, and d4) of the electrode lines can be equal to or different from each other.

Figure 17:
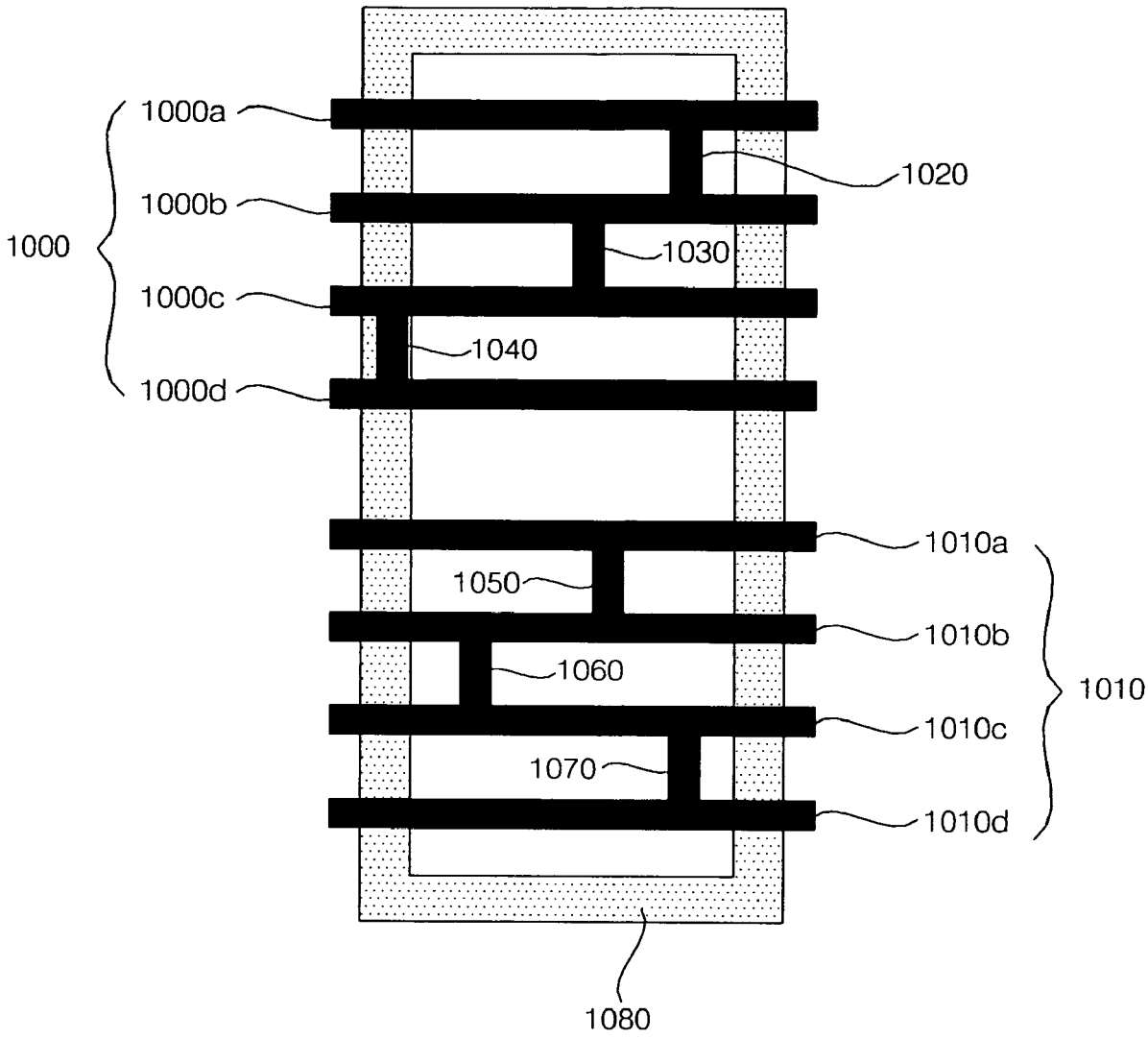
FIG. 17 is a cross-sectional view illustrating a sustain electrode structure according to a seventh exemplary embodiment of the present invention.

FIG. 17 is a cross-sectional view illustrating a sustain electrode structure according to a seventh exemplary embodiment of the present invention. Each sustain electrodes 1000 and 1010 includes four electrode lines 1000*a*, 1000*b*, 1000*c*, 1000*d*, and 1010*a*, 1010*b*, 1010*c*, 1010*d* crossing a discharge cell. The electrode lines cross the discharge cell, and extend in one direction of the plasma display panel.

Bridge electrodes 1020, 1030, 1040, 1050, 1060, and 1070 connect two electrode lines, respectively. The bridge electrodes 1020, 1030, 1040, 1050, 1060, and 1070 enable an initiated discharge to easily diffuse to the electrode line distant away from a center of the discharge cell. As shown in FIG. 17, the bridge electrodes 1020, 1030, 1040, 1050, 1060, and 1070 may not be consistent with each other in position, and any one bridge electrode 1040 can be also positioned over a barrier rib 1080.

Figure 18:
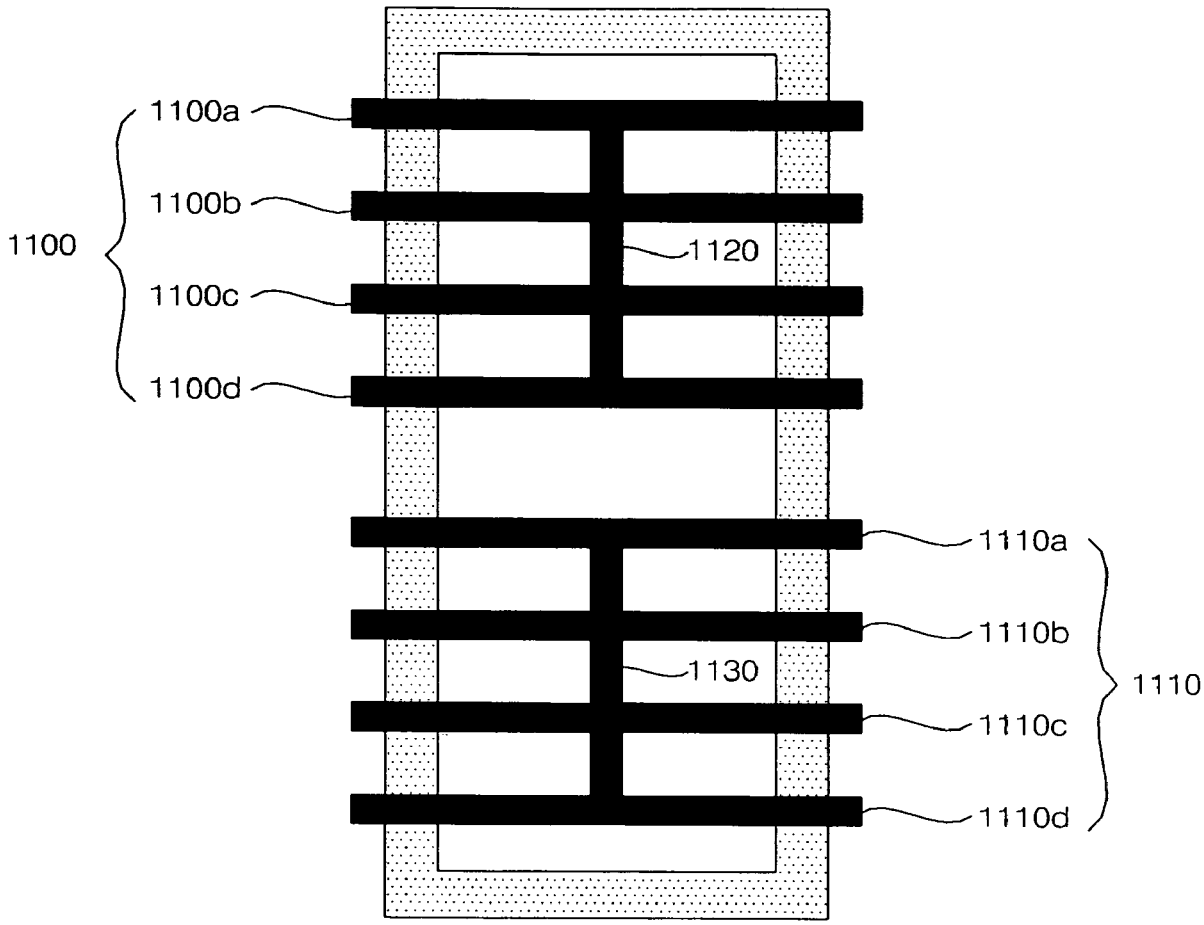
FIG. 18 is a cross-sectional view illustrating a sustain electrode structure according to an eighth exemplary embodiment of the present invention.

FIG. 18 is a cross-sectional view illustrating a sustain electrode structure according to an eighth exemplary embodiment of the present invention. Unlike FIG. 17, bridge electrodes connecting electrode lines are formed in the same position. The bridge electrodes 1120 and 1130 connecting four electrode lines 1100*a*, 1100*b*, 1100*c*, and 1110*a*, 1110*b*, 1110*c*, 1110*d* are formed at the sustain electrodes 1100 and 1110, respectively.

Figure 19:
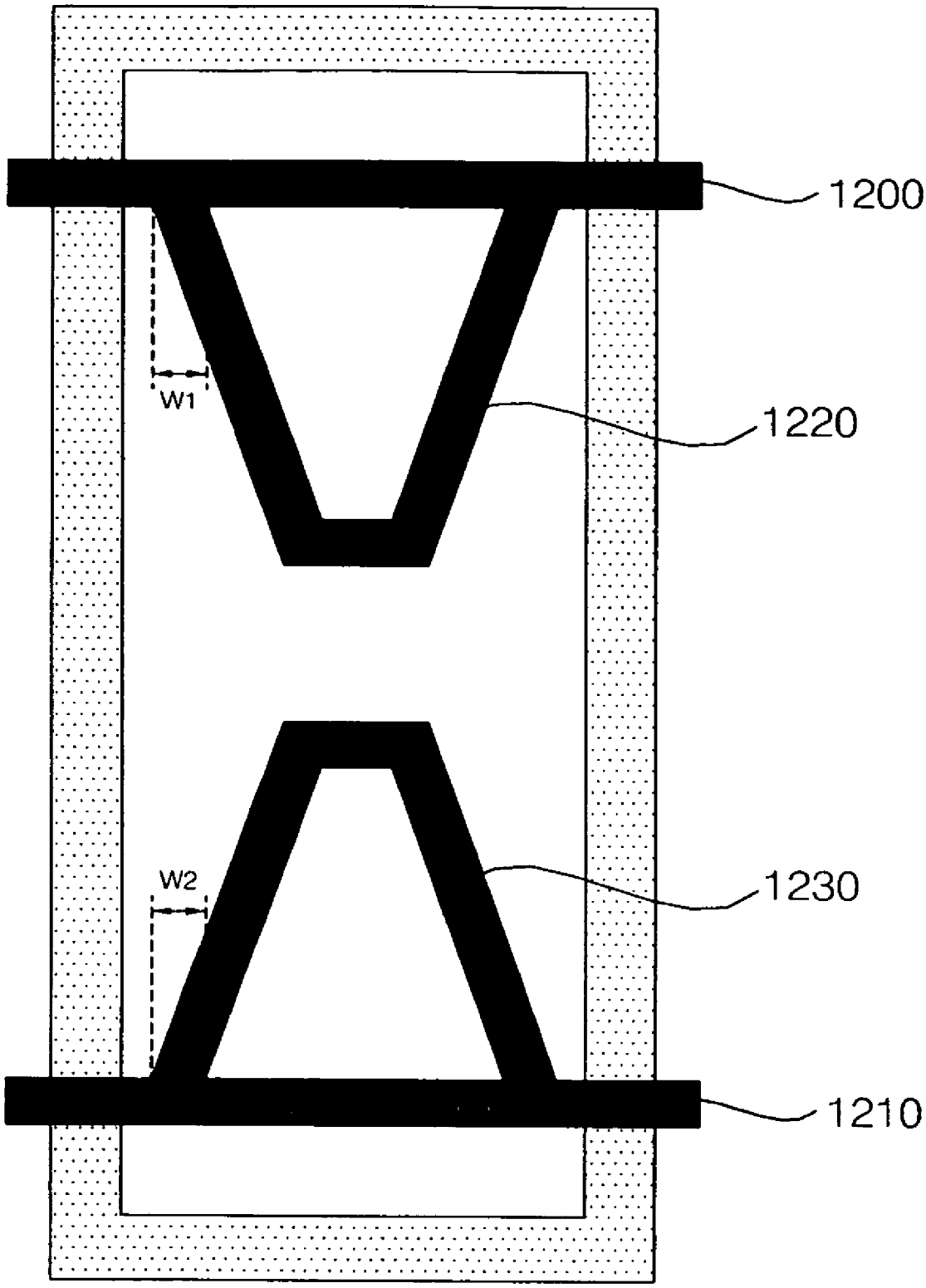
FIG. 19 is a cross-sectional view illustrating a sustain electrode structure according to a ninth exemplary embodiment of the present invention.

FIG. 19 is a cross-sectional view illustrating a sustain electrode structure according to a ninth exemplary embodiment of the present invention. Electrode lines 1200 and 1210 include protrusion electrodes 1220 and 1230 having closed loop shapes, respectively. By using the protrusion electrodes 1220 and 1230 having the closed loop shapes shown in FIG. 19, a discharge initiation voltage can be lowered and at the same time, an aperture ratio can be improved. The protrusion electrode and the closed loop can be variously modified in shape.

It is desirable that the protrusion electrodes 1220 and 1230 have line widths (W1 and W2) of about 35 μm to 45 μm. In case where the protrusion electrodes 1220 and 1230 have the line widths (W1 and W2) of the above range, an aperture ratio of the plasma display panel can be sufficiently guaranteed. Accordingly, a luminance of an image can be prevented from reducing because lights reflected and coming out from a front surface of a plasma display apparatus is blocked off by the protrusion electrodes.

Figure 20:
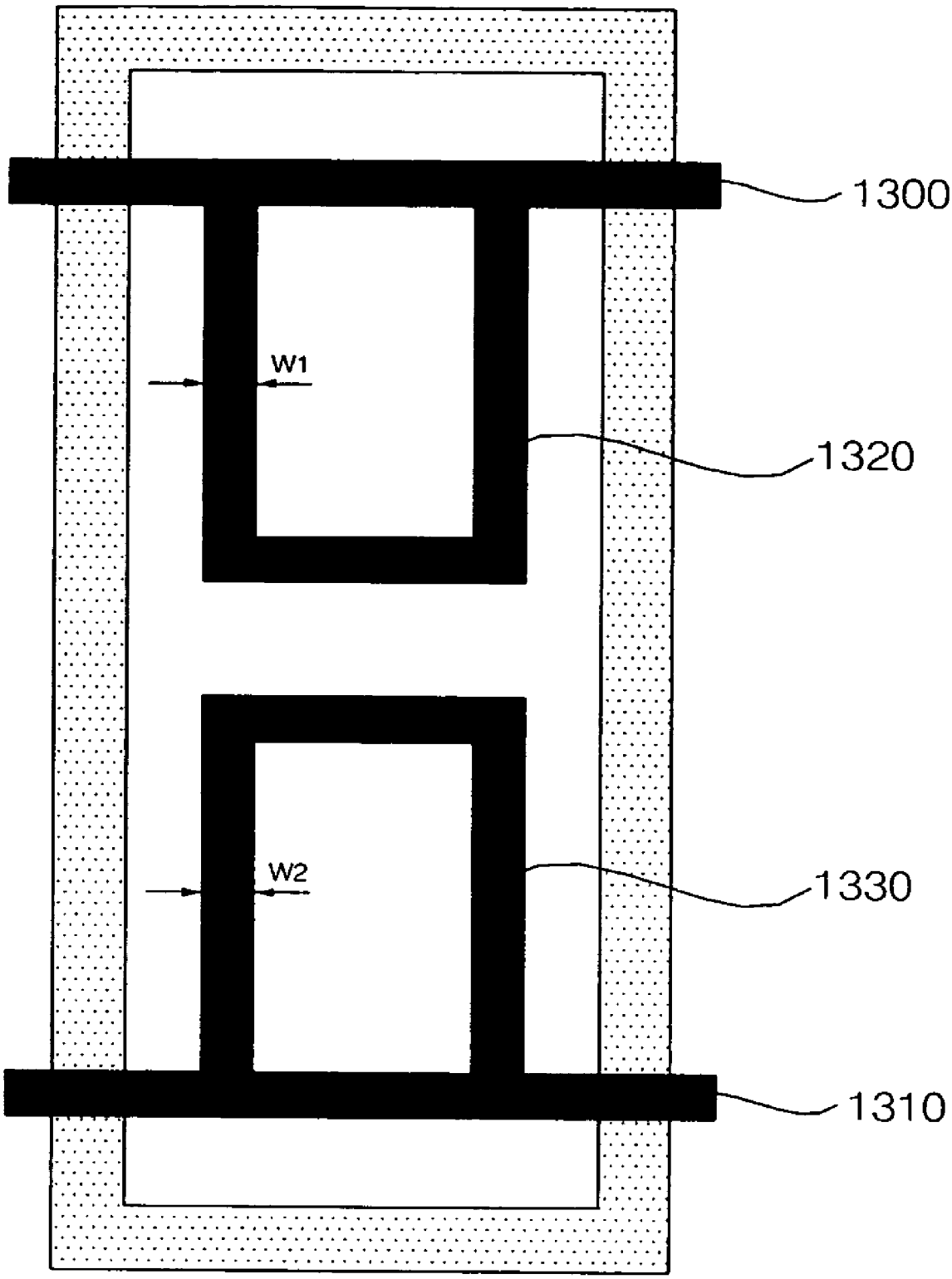
FIG. 20 is a cross-sectional view illustrating a sustain electrode structure according to a tenth exemplary embodiment of the present invention.

FIG. 20 is a cross-sectional view illustrating a sustain electrode structure according to a tenth exemplary embodiment of the present invention. Electrode lines 1300 and 1310 include protrusion electrodes 1320 and 1330 having rectangular shaped closed loops, respectively.

Figure 21A:
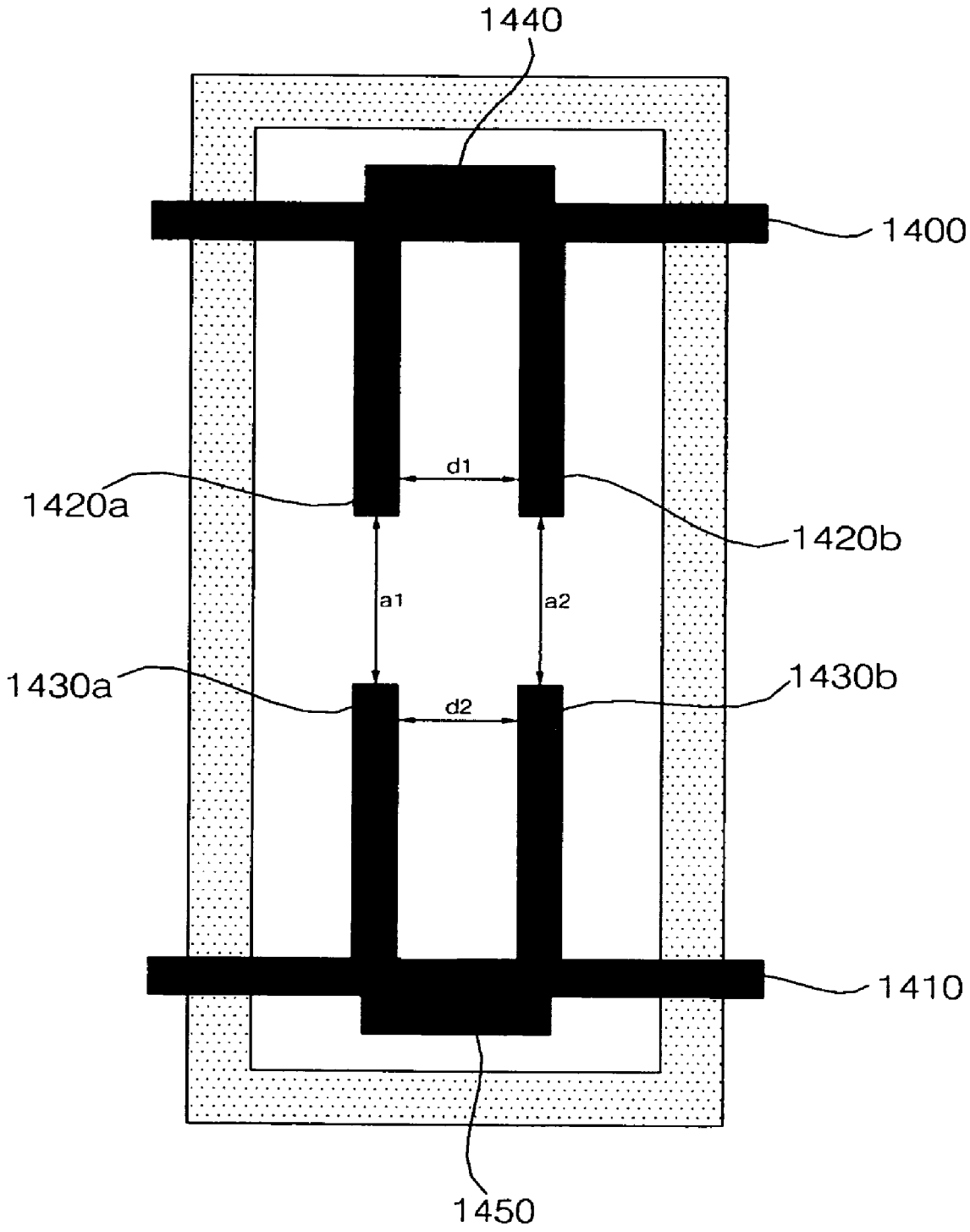
FIGS. 21A and 21B are cross-sectional views illustrating a sustain electrode structure according to an eleventh exemplary embodiment of the present invention.
Figure 21B:
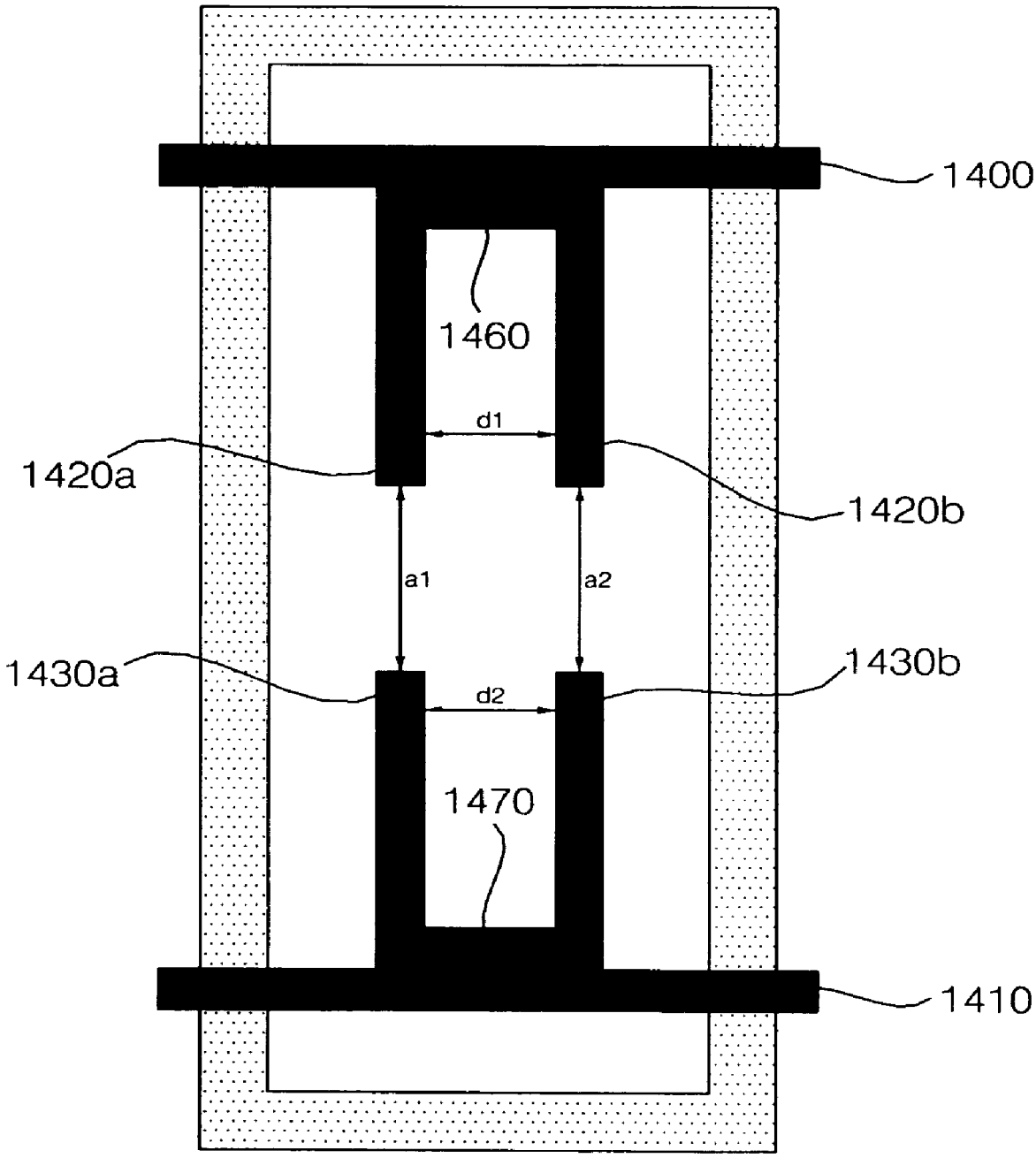

FIGS. 21A and 21B are cross-sectional views illustrating a sustain electrode structure according to an eleventh exemplary embodiment of the present invention. Electrode lines 1400 and 1410 includes first protrusion electrodes 1420*a*, 1420*b*, and 1430*a*, 1430*b* protruding in the direction of a center of a discharge cell; and second protrusion electrodes 1440, 1450, and 1460, 1470 protruding in an opposite direction of the center of the discharge cell or in the direction thereof, respectively.

As shown in FIG. 21A, it is desirable that each of the electrode lines 1400 and 1410 includes the two first protrusion electrodes 1420*a*, 1420*b*, and 1430*a*, 1430*b* protruding in the direction of the center of the discharge cell; and the one second protrusion electrode 1440 or 1450 protruding in the opposite direction of the center of the discharge cell. Alternately, as shown in FIG. 21B, the second protrusion electrodes 1460 and 1470 can also protrude in the direction of the center of the discharge cell.

In the above-described plasma display panel of the plasma display apparatus according to the present invention, the transparent electrode formed of ITO can be eliminated, thereby reducing a manufacturing cost of the plasma display panel. The protrusion electrodes protruding from the scan electrode or sustain electrode line in the direction of the center of the discharge or in the opposite direction thereof can be formed, thereby reducing the discharge initiation voltage and enhancing the discharge diffusion efficiency. The address electrode is separated at the center of the plasma display panel and the plasma display panel is divided, thereby stably keeping the discharge and making image data processing smooth in the plasma display panel. The scan electrode or the sustain electrode can be sequentially arranged at the center of the separated plasma display panel, thereby preventing the abnormal discharge from occurring by a concentration of the charges.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A plasma display apparatus, comprising:

an upper substrate;

a plurality of first electrodes and second electrodes formed over the upper substrate;

a lower substrate disposed facing the upper substrate; and a plurality of third electrodes formed over the lower substrate, wherein at least one of the plurality of first electrodes and second electrodes is formed as a single layer, and wherein each of the plurality of third electrodes is up/down separated at a center of an effective region, and wherein each of the plurality of third electrodes has a separated portion.

2. The apparatus of claim 1, wherein at least one of the plurality of first electrodes and second electrodes comprises:

a line part formed in a direction that intersects with the plurality of third electrodes; and a protrusion part that protrudes from the line part.

3. The apparatus of claim 1, wherein two last electrodes formed in an upper region and a lower region of the effective region, respectively, all are the first electrodes or the second electrodes.

4. The apparatus of claim 1, wherein each of the plurality of third electrodes has a curved shape at a terminal portion of its separated portion.

5. The apparatus of claim 4, wherein two adjacent electrodes all are the first electrodes at the center where the plurality of third electrodes is up/down separated.

6. The apparatus of claim 4, wherein an interval between two third electrodes up/down separated at the center is about 70 μm to 220 μm.

7. The apparatus of claim 1, wherein a width of the third electrode in a portion thereof that overlaps the first electrode or the second electrode is greater than a portion thereof that does not overlap the first electrode or the second electrode.

8. The apparatus of claim 1, wherein a width of the third electrode within the discharge cell where a phosphor layer is formed is greater than a width of the third electrode at an area outside of the discharge cell where the phosphor layer is not formed.

9. The apparatus of claim 1, wherein the lower substrate comprises:

a dielectric layer;

a first barrier rib and a second barrier rib for partitioning a discharge cell, the first and second barrier ribs being different in height and intersecting with each other; and a phosphor layer having a different thickness in at least one discharge cell for emitting a light of a different color.

10. The apparatus of claim 1, further comprising a barrier rib formed on the lower substrate so as to partition a plurality of discharge cells, wherein the barrier rib is formed between the separated third electrodes.

11. The apparatus of claim 1, further comprising:

a dielectric layer formed on the lower substrate and covering the plurality of third electrodes; and a barrier rib formed on the dielectric layer, wherein the dielectric layer is provided between gaps where the plurality of third electrodes are separated.

12. The plasma display apparatus of claim 1, wherein two discharge cells emitting lights of colors different from each other are different in pitch from each other.

13. The apparatus of claim 12, wherein a pitch of a discharge cell that emits red light is less than a pitch of a discharge cell that emits green or blue light.

* * * * *